US005174927A

United States Patent [19]

Honsa

[11] Patent Number: 5,174,927

[45] Date of Patent: Dec. 29, 1992

[54] PROCESS FOR PREPARING BRIGHTENER-CONTAINING LIQUID DETERGENT COMPOSITIONS WITH POLYHYDROXY FATTY ACID AMINES

[75] Inventor: Sandra L. Honsa, Middletown, Ohio

[73] Assignee: The Procter & Gamble Company, Cincinnati, Ohio

[21] Appl. No.: 755,909

[22] Filed: Sep. 6, 1991

Related U.S. Application Data

[63] Continuation-in-part of Ser. No. 742,562, Aug. 7, 1991, abandoned, which is a continuation of Ser. No. 589,759, Sep. 28, 1990, abandoned.

[51] Int. Cl.[5] ..... C11D 1/52; C11D 3/42; C11D 11/00; C11D 17/08

[52] U.S. Cl. ..... 252/543; 252/153; 252/173; 252/524; 252/529; 252/548; 252/DIG. 14

[58] Field of Search ..... 252/153, 173, 543, 528, 252/549, DIG. 14, 301.21, 301.23

[56] References Cited

U.S. PATENT DOCUMENTS

| | | | |
|---|---|---|---|
| 3,193,58 | 7/1965 | Crounse et al. | 260/240 |
| 1,985,424 | 12/1934 | Piggott | 260/124 |
| 2,016,962 | 10/1935 | Flint et al. | 260/127 |
| 2,643,198 | 6/1953 | Savidge et al. | 117/33.5 |
| 2,653,932 | 9/1953 | Schwartz | 260/211 |
| 2,662,073 | 12/1953 | Mehltretter et al. | 260/102 |
| 2,703,798 | 3/1955 | Schwartz | 260/211 |
| 2,717,894 | 9/1955 | Schwartz | 260/211 |
| 2,891,052 | 6/1959 | Boettner et al. | 260/211 |
| 2,954,347 | 9/1960 | St. John et al. | 252/109 |
| 2,965,576 | 12/1960 | Wilson | 252/137 |
| 2,982,737 | 5/1961 | Boettner | 252/152 |
| 2,991,296 | 7/1961 | Scherr | 260/404 |
| 3,128,287 | 4/1964 | Berg | 260/346.8 |
| 3,285,856 | 11/1966 | Lew | 252/152 |
| 3,308,067 | 3/1967 | Diehl | 252/161 |
| 3,312,626 | 4/1967 | Hooker | 252/152 |
| 3,312,627 | 4/1967 | Hooker | 252/152 |
| 3,455,839 | 7/1969 | Rauner | 252/321 |
| 3,576,749 | 4/1971 | Megson et al. | 252/132 |
| 3,635,830 | 1/1972 | Lamberti et al. | 252/152 |
| 3,637,495 | 1/1972 | Eckert et al. | 252/8.8 |
| 3,646,015 | 2/1972 | Hamilton | 260/240 CA |
| 3,654,166 | 4/1972 | Eckert et al. | 252/117 |
| 3,658,985 | 4/1972 | Olson et al. | 424/70 |
| 3,704,228 | 11/1972 | Eckert | 252/117 |
| 3,726,814 | 4/1973 | Lancz | 252/543 |
| 3,904,544 | 9/1975 | Clark et al. | 252/301.2 W |
| 3,914,185 | 10/1975 | Inamorato | 252/546 |
| 3,920,586 | 11/1975 | Bonaparte et al. | 252/531 |
| 3,929,678 | 12/1975 | Laughlin et al. | 252/526 |

(List continued on next page.)

FOREIGN PATENT DOCUMENTS

| | | |
|---|---|---|
| 206283 | 6/1956 | Australia . |
| 220676 | 5/1987 | European Pat. Off. . |
| 255033 | 7/1987 | European Pat. Off. . |
| 282816 | 9/1988 | European Pat. Off. . |
| 0285768 | 10/1988 | European Pat. Off. . |
| 285768 | 10/1988 | European Pat. Off. . |
| 314630 | 3/1989 | European Pat. Off. . |
| 237119 | 5/1990 | European Pat. Off. . |
| 422508 | 4/1991 | European Pat. Off. . |

(List continued on next page.)

OTHER PUBLICATIONS

"The Thermotropic Liquid-Crystalline Properties of Some Straight Chain Carbohydrate Amphiphiles", Liquid Crystals, 1988, vol. 3, No. 11, pp. 1569-1581 Goodby, Marcus, Chin Finn.

(List continued on next page.)

*Primary Examiner*—Dennis Albrecht

*Attorney, Agent, or Firm*—Jerry J. Yetter; Leonard W. Lewis

[57] ABSTRACT

The present invention provides highly-built, liquid detergent compositions comprising: one or more conventional anionic, nonionic or cationic detersive surfactants; one or more optical brighteners; one or more polyhydroxy fatty acid amides of the general formula

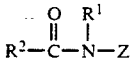

wherein $R^1$ is H, a $C_1$-$C_4$ hydrocarbyl, 2-hydroxy ethyl, 2-hydroxy propyl, or mixtures thereof, $R^2$ is a $C_5$-$C_{31}$ hydrocarbyl group, and Z is a polyhydroxyhydrocarbyl having a linear hydrocarbyl chain with at least 3 hydroxyl groups directly connected to the chain, or an alkoxylated derivative thereof; one or more detergent builders; and a liquid carrier; wherein the optical brightener is added to the detergent composition in admixture with the polyhydroxy fatty acid amide.

The present invention also provides a premix for use in the formulation of liquid detergent compositions, said premix comprising one or more optical brighteners, one or more polyhydroxy fatty acid amides and a liquid carrier.

The present invention further provides a method for preparing optical brightener-containing liquid detergent compositions wherein said brightener is added to said detergent compositions via the above-described premix.

2 Claims, No Drawings

U.S. PATENT DOCUMENTS

| | | | |
|---|---|---|---|
| 3,953,380 | 4/1976 | Sundby | 252/543 |
| 3,985,669 | 10/1976 | Krummel et al. | 252/116 |
| 3,988,255 | 10/1976 | Seiden | 252/107 |
| 4,000,093 | 12/1976 | Nicol et al. | 252/550 |
| 4,021,539 | 5/1977 | Möller et al. | 424/73 |
| 4,094,808 | 6/1978 | Stewart et al. | 252/186 |
| 4,129,511 | 12/1978 | Ogoshi et al. | 252/140 |
| 4,202,800 | 5/1980 | Ciko | 252/543 |
| 4,265,779 | 5/1981 | Gandolfo et al. | 252/135 |
| 4,268,262 | 5/1981 | Bechstedt | 8/137 |
| 4,268,406 | 5/1981 | O'Brien et al. | 252/105 |
| 4,292,212 | 9/1981 | Melby | 252/547 |
| 4,435,317 | 3/1984 | Gerritsen et al. | 252/547 |
| 4,483,780 | 11/1984 | Llenado | 252/135 |
| 4,483,781 | 11/1984 | Hartman | 252/174.12 |
| 4,540,821 | 9/1985 | Larkin et al. | 564/473 |
| 4,559,169 | 12/1985 | Wevers et al. | 252/543 |
| 4,562,002 | 12/1985 | Neiditch | 252/8.75 |
| 4,565,647 | 1/1986 | Llenado | 252/354 |
| 4,605,509 | 8/1986 | Corkill et al. | 252/131 |
| 4,663,071 | 5/1987 | Bush et al. | 252/174.19 |
| 4,664,839 | 5/1987 | Rieck | 252/175 |
| 4,689,167 | 8/1987 | Collins et al. | 252/95 |
| 4,704,224 | 11/1987 | Saud | 252/132 |
| 4,790,856 | 12/1988 | Wixon | 8/137 |
| 4,843,154 | 6/1989 | Klein et al. | 536/4.1 |
| 4,946,628 | 8/1990 | Schüssler et al. | 252/543 |
| 5,009,814 | 4/1991 | Kelkenberg et al. | 252/528 |

FOREIGN PATENT DOCUMENTS

| | | |
|---|---|---|
| 13746 | 9/1957 | Fed. Rep. of Germany . |
| 23346 | 6/1962 | Fed. Rep. of Germany . |
| 1261861 | 2/1968 | Fed. Rep. of Germany . |
| 2038103 | 2/1972 | Fed. Rep. of Germany . |
| 2226872 | 12/1973 | Fed. Rep. of Germany . |
| 2404070 | 8/1975 | Fed. Rep. of Germany . |
| 1360018 | 4/1964 | France . |
| 1550144 | 11/1968 | France . |
| 1580491 | 9/1969 | France . |
| 2657611 | 2/1991 | France . |
| 53839 | 2/1967 | German Democratic Rep. . |
| 3112904-A | 5/1991 | Japan . |
| WO83/04412 | 12/1983 | PCT Int'l Appl. . |
| 420518 | 11/1934 | United Kingdom . |
| 519381 | 3/1940 | United Kingdom . |
| 745036 | 2/1956 | United Kingdom . |
| 771423 | 4/1957 | United Kingdom . |
| 809060 | 2/1959 | United Kingdom . |
| 2028365 | 3/1980 | United Kingdom . |
| 2242686 | 9/1991 | United Kingdom . |

OTHER PUBLICATIONS

"Molecular and Crystal Structure of a Nonionic Detergent: Nonanoyl-N-methyl-glucamide", J. Chem. Soc. Chem. Commun., 1986, pp. 1573-1574, Muller-Fahrnow, Zabel, Steifa, Hilgenfeld.

"N-D-Gluco-N-methylalkanamide Compounds, a New Class of Non-Ionic Detergents For Membrane Biochemistry", Biochem. J. (1982), vol. 207, pp. 363-366, Hildreth.

Relative Stabilities of d-Gluicose-Amine Derivatives, Mohammad and Olcott, JACS, Apr. 1947, p. 969.

[23] 1-Amino-1-deoxy-D-glucitol, Long and Bollenback, Meth. Carbohyd. Chem., vol. 2, (1963), pp 79-83.

The Reaction of Glucose with Some Amines, Mitts and Hixon, JACS, vol. 66, (1944), pp. 483-486.

Synthesis of $^{14}C$-Labeled N-Methylglucamine, Heeg et al, Can. J. of Pharmaceutical Sciences, vol. 10, No. 3 (1975), pp. 75-76.

H. Kelkenberg, Tenside Surfactants Detergents 25 (1988) pp. 8-13.

Synthesis of Long Chain N-Alkyllactylamines from Unprotected Lactose—A new Series of Non-Ionic Surfactants, Latge et al, J. Dispersion Science and Technology, 12(3&4), pp. 227-237 (1991).

U.S. patent application Ser. No. 07/755,900, filed Sep. 6, 1991 (Ofosu-Asante et al) entitled Detergent Compositions Containing Calcium and Polyhydroxy Fatty Acid Amide (not enclosed).

Soaps Cosmetics Chemical Specialties, "Fluorescent Whitening Agents", W. R. Findley, vol. 64, No. 7, Jul. 1988, New York, pp. 44-50.

PROCESS FOR PREPARING BRIGHTENER-CONTAINING LIQUID DETERGENT COMPOSITIONS WITH POLYHYDROXY FATTY ACID AMINES

CROSS REFERENCE TO RELATED APPLICATION

This application is a continuation-in-part of copending application Ser. No. 742,562 filed Aug. 7, 1991, now abandoned, which is a continuation of application Ser. No. 589,759 filed Sept. 28, 1990, now abandoned.

TECHNICAL FIELD

Polyhydroxy fatty acid amides are used in the formulation of liquid detergent compositions containing optical brighteners.

BACKGROUND OF THE INVENTION

Numerous optical brightener materials are used in detergent compositions. Such materials are designed to deposit onto fibers and fabrics and to alter the chromaticity of items to yield a more preferred white. Optical brighteners work by converting invisible, ultraviolet radiation to a visible blue frequency which shifts the chromaticity of a surface away from a yellow cast to a preferred clean bluish cast.

In general, such optical brightener molecules have at least one relatively large chromophoric group and one or more substituent groups. For use in laundry detergents, the molecules must not only exhibit the correct optical properties, but also must be capable of being deposited onto fabrics from an aqueous wash liquor containing various surfactants, detergency builders and other detersive adjuncts.

Detergent compositions containing optical brighteners may be formulated in a number of ways. One formulation method involves adding the brightener to the detergent composition as a free powder. However, this preparation method causes problems such as dusting, which can be particularly troublesome at a detergent composition manufacturing site. Another problem with this formulation method is that optical brighteners can require long dispersing times when added as powders to liquid detergent compositions.

One method of avoiding such dusting and dispersion problems is to add the brighteners to the liquid detergent compositions via a premix which contains the optical brighteners and an additional compound.

However, other problems arise when optical brighteners are added to liquid detergent compositions as a premix, especially when added to highly built liquid detergent compositions. For example, when the optical brightener is combined with nonionic surfactants such as Neodol ® in the premix, the addition of the premix to highly built liquid detergent compositions causes haziness and phase separation. When the optical brightener is combined with alkyl polyglycoside in the premix, the addition of the premix to highly built liquid detergent compositions results in a milky, one-phase product.

Therefore, it would be desirable to develop a premix by which brighteners can be added to highly built liquid detergent compositions which avoid such problems. It has now been discovered that if brighteners are added to such detergent compositions via a premix containing the brighteners and certain polyhydroxy fatty acid amides, the aforementioned dusting and dispersing problems can be avoided. Furthermore, adding brighteners via such a premix allows for the formulation of clear, isotropic, highly built liquid detergent compositions. Additionally, the use of such a premix, in certain cases, allows for formulation and performance flexibility by enabling facile addition of optical brighteners which are otherwise difficult to incorporate into liquid detergent compositions.

BACKGROUND ART

A variety of polyhydroxy fatty acid amides have been described in the art. N-acyl, N-methyl glucamides, for example, are disclosed by J. W. Goodby, M. A. Marcus, E. Chin, and P. L. Finn in "The Thermotropic Liquid-Crystalline Properties of Some Straight Chain Carbohydrate Amphiphiles," Liquid Crystals, 1988, Volume 3, No. 11, pp 1569–1581, and by A. Muller-Fahrnow, V. Zabel, M. Steifa, and R. Hilgenfeld in "Molecular and Crystal Structure of a Nonionic Detergent: Nonanoyl-N-methylglucamide," J. Chem. Soc. Chem. Commun., 1986, pp 1573–1574. The use of N-alkyl polyhydroxyamide surfactants has been of substantial interest recently for use in biochemistry, for example in the dissociation of biological membranes. See, for example, the journal article "N-D-Gluco-N-methyl-alkanamide Compounds, a New Class of Non-Ionic Detergents For Membrane Biochemistry," Biochem. J. (1982), Vol. 207, pp 363–366, by J. E. K. Hildreth.

The use of N-alkyl glucamides in detergent compositions has also been discussed. U.S. Pat. No. 2,965,576, issued Dec. 20, 1960 to E. R. Wilson, and G.B. Patent 809,060, published Feb. 18, 1959, assigned to Thomas Hedley & Co., Ltd. relate to detergent compositions containing anionic surfactants and certain amide surfactants, which can include N-methyl glucamide, added as a low temperature suds enhancing agent. These compounds include an N-acyl radical of a higher straight chain fatty acid having 10–14 carbon atoms. These compositions may also contain auxiliary materials such as alkali metal phosphates, alkali metal silicates, sulfates, and carbonates. It is also generally indicated that additional constituents to impart desirable properties to the composition can also be included in the compositions, such as fluorescent dyes, bleaching agents, perfumes, etc.

U.S. Pat. No. 2,703,798, issued Mar. 8, 1955 to A. M. Schwartz, relates to aqueous detergent compositions containing the condensation reaction product of N-alkyl glucamine and an aliphatic ester of a fatty acid. The product of this reaction is said to be useable in aqueous detergent compositions without further purification. It is also known to prepare a sulfuric ester of acylated glucamine as disclosed in U.S. Pat. No. 2,717,894, issued Sept. 13, 1955, to A. M. Schwartz.

PCT International Application WO 83/04412, published Dec. 22, 1983, by J. Hildreth, relates to amphiphilic compounds containing polyhydroxyl aliphatic groups said to be useful for a variety of purposes including use as surfactants in cosmetics, drugs, shampoos, lotions, and eye ointments, as emulsifiers and dispensing agents for medicines, and in biochemistry for solubilizing membranes, whole cells, or other tissue samples, and for preparing liposomes. Included in this disclosure are compounds of the formula $R'CON(R)CH_2R''$ and $R''CON(R)R'$ wherein R is hydrogen or an organic grouping, R' is an aliphatic hydrocarbon group of at least three carbon atoms, and R'' is the residue of an aldose.

European Patent 0 285 768, published Oct. 12, 1988, H. Kelkenberg, et al., relates to the use of N-polyhydroxy alkyl fatty acid amides as thickening agents in aqueous detergent systems. Included are amides of the formula $R_1C(O)N(X)R_2$ wherein $R_1$ is a $C_1$–$C_{17}$ (preferably $C_7$–$C_{17}$) alkyl, $R_2$ is hydrogen, a $C_1$–$C_{18}$ (preferably $C_1$–$C_6$) alkyl, or an alkylene oxide, and X is a polyhydroxy alkyl having four to seven carbon atoms, e.g., N-methyl, coconut fatty acid glucamide. The thickening properties of the amides are indicated as being of particular use in liquid surfactant systems containing paraffin sulfonate, although the aqueous surfactant systems can contain other anionic surfactants, such as alkylaryl sulfonates, olefin sulfonate, sulfosuccinic acid half ester salts, and fatty alcohol ether sulfonates, and nonionic surfactants such as fatty alcohol polyglycol ether, alkylphenol polyglycol ether, fatty acid polyglycol ester, polypropylene oxide-polyethylene oxide mixed polymers, etc. Paraffin sulfonate/N-methyl coconut fatty acid glucamide/nonionic surfactant shampoo formulations are exemplified. In addition to thickening attributes, the N-polyhydroxy alkyl fatty acid amides are said to have superior skin tolerance attributes.

U.S. Pat. No. 2,982,737, issued May 2, 1961, to Boettner, et al., relates to detergent bars containing urea, sodium lauryl sulfate anionic surfactant, and an N-alkylglucamide nonionic surfactant which is selected from N-methyl,N-sorbityl lauramide and N-methyl, N-sorbityl myristamide.

Other glucamide surfactants are disclosed, for example, in DT 2,226,872, published Dec. 20, 1973, H. W. Eckert, et al., which relates to washing compositions comprising one or more surfactants and builder salts selected from polymeric phosphates, sequestering agents, and washing alkalis, improved by the addition of an N-acylpolyhydroxyalkyl-amine of the formula $R_1C(O)N(R_2)CH_2(CHOH)_n$—$CH_2OH$, wherein $R_1$ is a $C_1$–C3 alkyl, $R_2$ is a $C_{10}$–$C_{22}$ alkyl, and n is 3 or 4. The N-acylpolyhydroxyalkyl-amine is added as a soil suspending agent.

U.S. Pat. No. 3,654,166, issued Apr. 4, 1972, to H. W. Eckert, et al., relates to detergent compositions comprising at least one surfactant selected from the group of anionic, zwitterionic, and nonionic surfactants and, as a textile softener, an N-acyl, N-alkyl polyhydroxylalkyl compound of the formula $R_1N(Z)C(O)R_2$ wherein $R_1$ is a $C_{10}$–$C_{22}$ alkyl, $R_2$ is a $C_7$–$C_{21}$ alkyl, $R_1$ and $R_2$ total from 23 to 39 carbon atoms, and Z is a polyhydroxyalkyl which can be —$CH_2(CHOH)_m$—$CH_2OH$ where m is 3 or 4.

U.S. Pat. No. 4,021,539, issued May 3, 1977, to H. Möller, et al., relates to skin treating cosmetic compositions containing N-polyhydroxylalkyl-amines which include compounds of the formula $R_1N(R)CH(CHOH)_mR_2$ wherein $R_1$ is H, lower alkyl, hydroxy-lower alkyl, or aminoalkyl, as well as heterocyclic aminoalkyl, R is the same as $R_1$ but both cannot be H, and $R_2$ is $CH_2OH$ or COOH.

French Patent 1,360,018, Apr. 26, 1963, assigned to Commercial Solvents Corporation, relates to solutions of formaldehyde stabilized against polymerization with the addition of amides of the formula $RC(O)N(R_1)G$ wherein R is a carboxylic acid functionality having at least seven carbon atoms, $R_1$ is hydrogen or a lower alkyl group, and G is a glycitol radical with at least 5 carbon atoms.

German Patent 1,261,861, Feb. 29, 1968, A. Heins, relates to glucamine derivatives useful as wetting and dispersing agents of the formula $N(R)(R_1)(R_2)$ wherein R is a sugar residue of glucamine, $R_1$ is a $C_{10}$–$C_{20}$ alkyl radical, and $R_2$ is a $C_1$–$C_5$ acyl radical.

G.B. Patent 745,036, published Feb. 15, 1956, assigned to Atlas Powder Company, relates to heterocyclic amides and carboxylic esters thereof that are said to be useful as chemical intermediates, emulsifiers, wetting and dispersing agents, detergents, textile softeners, etc. The compounds are expressed by the formula $N(R)(R_1)C(O)R_2$ wherein R is the residue of an anhydrized hexane pentol or a carboxylic acid ester thereof, $R_1$ is a monovalent hydrocarbon radical, and —$C(O)R_2$ is the acyl radical of a carboxylic acid having from 2 to 25 carbon atoms.

U.S. Pat. No. 3,312,627, issued Apr. 4, 1967 to D. T. Hooker, discloses solid toilet bars that are substantially free of anionic detergents and alkaline builder materials, and which contain lithium soap of certain fatty acids, a nonionic surfactant selected from certain propylene oxide-ethylenediamine-ethylene oxide condensates, propylene oxide-propylene glycol-ethylene oxide condensates, and polymerized ethylene glycol, and also contain a nonionic lathering component which can include polyhydroxyamide of the formula $RC(O)NR^1(R^2)$ wherein RC(O) contains from about 10 to about 14 carbon atoms, and $R^1$ and $R^2$ each are H or $C_1$–$C_6$ alkyl groups, said alkyl groups containing a total number of carbon atoms of from 2 to about 7 and a total number of substituent hydroxyl groups of from 2 to about 6. A substantially similar disclosure is found in U.S. Pat. No. 3,312,626, also issued Apr. 4, 1967 to D. T. Hooker.

However, none of these references disclose clear, isotropic, highly built liquid detergent compositions prepared by adding one or more optical brighteners in admixture with one or more polyhydroxy fatty acid amides. Nor do these references disclose preparing a premix containing one or more optical brighteners and one or more polyhydroxy fatty acid amides, or a method of preparing brightener-containing liquid detergent compositions by adding the optical brighteners to the detergent compositions via said premix.

It is therefore an object of the present invention to provide such clear, isotropic brightener-containing, highly built liquid detergent compositions.

It is another object of the present invention to provide an optical brightener-containing premix which can be used as a vehicle for adding brighteners to liquid detergent compositions.

It is still another object of the present invention to provide a process for preparing optical brightener-containing liquid detergent compositions, wherein said optical brightener is added in conjunction with one or more polyhydroxy fatty acid amides in a premix.

These objects will be realized by the present invention.

SUMMARY OF THE INVENTION

The present invention is directed toward highly-built, liquid detergent compositions comprising:

(a) one or more conventional anionic, nonionic or cationic detersive surfactants;

(b) one or more optical brighteners;

(c) one or more polyhydroxy fatty acid amides of the general formula

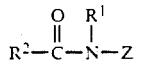

wherein $R^1$ is H, a $C_1$–$C_4$ hydrocarbyl, 2-hydroxy ethyl, 2-hydroxy propyl, or mixtures thereof, $R^2$ is a $C_5$–$C_{31}$ hydrocarbyl group, and Z is a polyhydroxyhydrocarbyl having a linear hydrocarbyl chain with at least 3 hydroxyl groups directly connected to the chain, or an alkoxylated derivative thereof;

(d) one or more detergent builders; and (e) a liquid carrier;

wherein the optical brightener is added to the detergent composition in admixture with the polyhydroxy fatty acid amide.

The present invention is also directed toward a premix for use in the formulation of liquid detergent compositions, said premix comprising one or more optical brighteners, one or more polyhydroxy fatty acid amides and a liquid carrier.

The present invention is also directed toward a method for preparing optical brightener-containing liquid detergent compositions wherein said brightener is added to said detergent compositions via the above-described premix.

DETAILED DESCRIPTION OF THE INVENTION DETERGENT COMPOSITIONS

The highly built liquid detergent compositions of the present invention comprise one or more conventional anionic, nonionic or cationic detersive surfactants, one or more optical brighteners, one or more polyhydroxy fatty acid amides, one or more detergent builders, and a liquid carrier. By "highly built" it is meant that the liquid detergent compositions comprise at least about 10% by weight of one or more detergent builders.

The detergent compositions of the present invention preferably comprise from about 1% to about 30%, more preferably from about 8% to about 18%, most preferably from about 10% to about 15% by weight of the detersive surfactants; from about 0.01% to about 3%, more preferably from about 0.01% to about 2.5%, most preferably from about 0.01% to about 2% by weight of the optical brighteners; from about 0.5% to about 30%, more preferably from about 0.5% to about 20%, most preferably from about 0.5% to about 15% by weight of the polyhydroxy fatty acid amides; from about 10% to about 50%, more preferably from about 15% to about 35%, most preferably from about 15% to about 30% by weight of the detergent builders; and from about 20% to about 90%, more preferably from about 30% to about 77%, most preferably from about 40% to about 75% by weight of the liquid carrier.

Anionic Surfactants

One type of anionic surfactant which can be utilized encompasses alkyl ester sulfonates. Alkyl ester sulfonate surfactants hereof include linear esters of $C_8$–$C_{20}$ carboxylic acids (i.e., fatty acids) which are sulfonated with gaseous $SO_3$ according to "The Journal of the American Oil Chemists Society," 52 (1975), pp. 323–329. Suitable starting materials would include natural fatty substances as derived from tallow, palm oil, etc.

The preferred alkyl ester sulfonate surfactant, especially for laundry applications, comprise alkyl ester sulfonate surfactants of the structural formula:

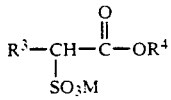

wherein $R^3$ is a $C_8$–$C_{20}$ hydrocarbyl, preferably an alkyl, or combination thereof, $R^4$ is a $C_1$–$C_6$ hydrocarbyl, preferably an alkyl, or combination thereof, and M is a cation which forms a water soluble salt with the alkyl ester sulfonate. Suitable salt-forming cations include metals such as sodium, potassium, and lithium, and substituted or unsubstituted ammonium cations, such as monoethanolamine, diethanolamine, and triethanolamine. Preferably, $R^3$ is $C_{10}$–$C_{16}$ alkyl, and $R^4$ is methyl, ethyl or isopropyl. Especially preferred are the methyl ester sulfonates wherein $R^3$ is $C_{10}$–$C_{16}$ alkyl.

Alkyl Sulfate Surfactant

Alkyl sulfate surfactants hereof are water soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations such as tetramethylammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Alkyl Alkoxylated Sulfate Surfactant

Alkyl alkoxylated sulfate surfactants hereof are water soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethyl-ammonium cations and quaternary ammonium cations such as tetramethyl-ammonium and dimethyl piperdinium cations and those derived from alkylamines such as ethylamine, diethylamine, triethyl-amine, mixtures thereof, and the like. Exemplary surfactants are $C_{12}$–$C_{18}$ alkyl polyethoxylate (1.0) sulfate ($C_{12}$–$C_{18}E(1.0)M$), $C_{12}$–$C_{18}$ alkyl polyethoxylate (2.25) sulfate ($C_{12}$–$C_{18}E(2.25)M$), $C_{12}$–$C_{18}$ alkyl polyethoxylate (3.0) sulfate ($C_{12}$–$C_{18}E(3.0)M$), and $C_{12}$–$C_{18}$ alkyl polyethoxylate (4.0) sulfate ($C_{12}$–$C_{18}E(4.0)M$), wherein M is conveniently selected from sodium and potassium.

Other Anionic Surfactants

Other anionic surfactants useful for detersive purposes can also be included in the compositions hereof. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$alkylpolyglycolethersulfates (containing up to 10 moles of ethylene oxide); alkyl glycerol sulfonates, fatty acyl glycerol sulfonates, fatty oleyl glycerol sulfates, alkyl phenol ethylene oxide ether sulfates, paraffin sulfonates, alkyl phosphates, isethionates such as the acyl isethionates, acyl taurates, fatty acid amides of methyl tauride, alkyl succinamates and sulfosuccinates, monoesters of sulfosuccinates (especially saturated and unsaturated $C_{12}$–$C_{18}$ monoesters) and diesters of sulfosuccinates (especially saturated and unsaturated $C_6$–$C_{12}$ diesters), acyl sarcosinates, sulfates of alkylpolysaccharides such as the sulfates of alkylpolyglucoside (the nonionic nonsulfated compounds being described below), branched primary alkyl sulfates, and fatty acids esterified with isethionic acid and neutralized with sodium hydroxide. Resin acids and hydrogenated resin acids are also suitable, such as rosin, hydrogenated rosin, and resin acids and hydrogenated resin acids present in or derived from tall oil. Further examples are described in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23 (herein incorporated by reference).

Nonionic Detergent Surfactants

Suitable nonionic detergent surfactants are generally disclosed in U.S. Pat. No. 3,929,678, Laughlin et al., issued Dec. 30, 1975, at column 13, line 14 through column 16, line 6, incorporated herein by reference. Exemplary, non-limiting classes of useful nonionic surfactants are listed below. The nonionic polyhydroxy fatty acid amide contained in the composition of the present invention is not considered to be a member of these conventional, nonionic detersive surfactants for purposes of this invention.

1. The polyethylene, polypropylene, and polybutylene oxide condensates of alkyl phenols. In general, the polyethylene oxide condensates are preferred. These compounds include the condensation products of alkyl phenols having an alkyl group containing from about 6 to about 12 carbon atoms in either a straight chain or branched chain configuration with the alkylene oxide. In a preferred embodiment, the ethylene oxide is present in an amount equal to from about 5 to about 25 moles of ethylene oxide per mole of alkyl phenol. Commercially available nonionic surfactants of this type include Igepal TM CO-630, marketed by the GAF Corporation; and Triton TM X-45, X-114, X-100, and X-102, all marketed by the Rohm & Haas Company.

2. The condensation products of aliphatic alcohols with from about 1 to about 25 moles of ethylene oxide. The alkyl chain of the aliphatic alcohol can either be straight or branched, primary or secondary, and generally contains from about 8 to about 22 carbon atoms. Particularly preferred are the condensation products of alcohols having an alkyl group containing from about 10 to about 20 carbon atoms with from about 2 to about 10 moles of ethylene oxide per mole of alcohol. Examples of commercially available nonionic surfactants of this type include Tergitol TM 15-S-9 (the condensation product of $C_{11}$–$C_{15}$ linear alcohol with 9 moles ethylene oxide), Tergitol TM 24-L-6 NMW (the condensation product of $C_{12}$–$C_{14}$ primary alcohol with 6 moles ethylene oxide with a narrow molecular weight distribution), both marketed by Union Carbide Corporation; Neodol TM 45-9 (the condensation product of $C_{14}$–$C_{15}$ linear alcohol with 9 moles of ethylene oxide), Neodol TM 23-6.5 (the condensation product of $C_{12}$–$C_{13}$ linear alcohol with 6.5 moles of ethylene oxide), Neodol TM 45-7 (the condensation product of $C_{14}$–$C_{15}$ linear alcohol with 7 moles of ethylene oxide), Neodol TM 45-4 (the condensation product of $C_{14}$–$C_{15}$ linear alcohol with 4 moles of ethylene oxide), marketed by Shell Chemical Company, and Kyro TM EOB (the condensation product of $C_{13}$–$C_{15}$ alcohol with 9 moles ethylene oxide), marketed by The Procter & Gamble Company.

3. The condensation products of ethylene oxide with a hydrophobic base formed by the condensation of propylene oxide with propylene glycol. The hydrophobic portion of these compounds preferably has a molecular weight of from about 1500 to about 1800 and exhibits water insolubility. The addition of polyoxyethylene moieties to this hydrophobic portion tends to increase the water solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commercially-available Pluronic TM surfactants, marketed by BASF.

4. The condensation products of ethylene oxide with the product resulting from the reaction of propylene oxide and ethylenediamine. The hydrophobic moiety of these products consists of the reaction product of ethylenediamine and excess propylene oxide, and generally has a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic TM compounds, marketed by BASF.

5. Semi-polar nonionic surfactants are a special category of nonionic surfactants which include water-soluble amine oxides containing one alkyl moiety of from about 10 to about 18 carbon atoms and 2 moieties selected from the group consisting of alkyl groups and hydroxyalkyl groups containing from about 1 to about 3 carbon atoms; water-soluble phosphine oxides containing one alkyl moiety of from about 10 to about 18 carbon atoms and 2 moieties selected from the group consisting of alkyl groups and hydroxyalkyl groups containing from about 1 to about 3 carbon atoms; and water-soluble sulfoxides containing one alkyl moiety of from about 10 to about 18 carbon atoms and a moiety selected from the group consisting of alkyl and hydroxyalkyl moieties of from about 1 to about 3 carbon atoms.

Semi-polar nonionic detergent surfactants include the amine oxide surfactants having the formula

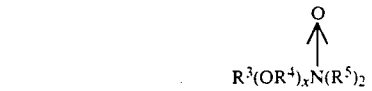

wherein $R^3$ is an alkyl, hydroxyalkyl, or alkyl phenyl group or mixtures thereof containing from about 8 to about 22 carbon atoms; $R^4$ is an alkylene or hydroxyalkylene group containing from about 2 to about 3 carbon atoms or mixtures thereof; x is from 0 to about 3; and each $R^5$ is an alkyl or hydroxyalkyl group containing from about 1 to about 3 carbon atoms or a polyethylene oxide group containing from about 1 to about 3 ethylene oxide groups. The $R^5$ groups can be attached to each other, e.g., through an oxygen or nitrogen atom, to form a ring structure.

These amine oxide surfactants in particular include $C_{10}$–$C_{18}$ alkyl dimethyl amine oxides and $C_8$–$C_{12}$ alkoxy ethyl dihydroxy ethyl amine oxides.

6. Alkylpolysaccharides disclosed in U.S. Pat. No. 4,565,647, Llenado, issued Jan. 21, 1986, having a hydrophobic group containing from about 6 to about 30 carbon atoms, preferably from about 10 to about 16 carbon atoms and a polysaccharide, e.g., a polyglycoside, hydrophilic group containing from about 1.3 to about 10, preferably from about 1.3 to about 3, most preferably from about 1.3 to about 2.7 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Optionally, and less desirably, there can be a polyalkylene-oxide chain joining the hydrophobic moiety and the polysaccharide moiety. The preferred alkyleneoxide is ethylene oxide. Typical hydrophobic groups include alkyl groups, either saturated or unsaturated, branched or unbranched containing from about 8 to about 18, preferably from about 10 to about 16, carbon atoms. Preferably, the alkyl group is a straight chain saturated alkyl group. The alkyl group can contain up to about 3 hydroxy groups and/or the polyalkyleneoxide chain can contain up to about 10, preferably less than 5, alkyleneoxide moieties. Suitable alkyl polysaccharides are octyl, nonyldecyl, undecyldodecyl, tridecyl, tetradecyl, pentadecyl, hexadecyl, heptadecyl, and octadecyl, di-, tri-, tetra-, penta-, and hexaglucosides, galactosides, lactosides, glucoses, fructosides, fructoses and/or galactoses. Suitable mixtures include coconut alkyl, di-, tri-, tetra-, and pentaglucosides and tallow alkyl tetra-, penta-, and hexaglucosides.

The preferred alkylpolyglycosides have the formula $$R^2O(C_nH_{2n}O)_t(\text{glycosyl})_x$$

wherein $R^2$ is selected from the group consisting of alkyl, alkylphenyl, hydroxyalkyl, hydroxyalkylphenyl, and mixtures thereof in which the alkyl groups contain from about 10 to about 18, preferably from about 12 to about 14, carbon atoms; n is 2 or 3, preferably 2; t is from 0 to about 10, preferably 0; and x is from about 1.3 to about 10, preferably from about 1.3 to about 3, most preferably from about 1.3 to about 2.7. The glycosyl is preferably derived from glucose. To prepare these compounds, the alcohol or alkylpolyethoxy alcohol is formed first and then reacted with glucose, or a source of glucose, to form the glucoside (attachment at the 1-position). The additional glycosyl units can then be attached between their 1 position and the preceding glycosyl units 2-, 3-, 4- and/or 6-position, preferably predominately the 2-position.

7. Fatty acid amide surfactants having the formula:

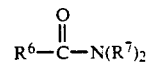

wherein $R^6$ is an alkyl group containing from about 7 to about 21 (preferably from about 9 to about 17) carbon atoms and each $R^7$ is selected from the group consisting of hydrogen, $C_1$–$C_4$ alkyl, $C_1$–$C_4$ hydroxyalkyl, and $-(C_2H_4O)_xH$ where x varies from about 1 to about 3.

Preferred amides are $C_8$–$C_{20}$ ammonia amides, monoethanolamides, diethanolamides, and isopropanolamides.

Cationic Surfactants

Cationic detersive surfactants can also be included in detergent compositions of the present invention. Cationic surfactants include the ammonium surfactants such as alkyldimethylammonium halogenides, and those surfactants having the formula:

$$[R^2(OR^3)_y][R^4(OR^3)_y]_2R^5N^+X^-$$

wherein $R^2$ is an alkyl or alkyl benzyl group having from about 8 to about 18 carbon atoms in the alkyl chain, each $R^3$ is selected from the group consisting of $-CH_2CH_2-$, $-CH_2CH(CH_3)-$, $-CH_2CH(CH_2OH)-$, $-CH_2CH_2CH_2-$, and mixtures thereof; each $R^4$ is selected from the group consisting of $C_1$–$C_4$ alkyl, $C_1$–$C_4$ hydroxyalkyl, benzyl ring structures formed by joining the two $R^4$ groups, $-CH_2CHOH-CHOHCOR^6CHOHCH_2OH$ wherein $R^6$ is any hexose or hexose polymer having a molecular weight less than about 1000, and hydrogen when y is not O; $R^5$ is the same as $R^4$ or is an alkyl chain wherein the total number of carbon atoms of $R^2$ plus $R^5$ is not more than about 18; each y is from 0 to about 10 and the sum of the y values is from 0 to about 15; and X is any compatible anion.

Other cationic surfactants useful herein are also described in U.S. Pat. No. 4,228,044, Cambre, issued Oct. 14, 1980, incorporated herein by reference.

Other Surfactants

Ampholytic surfactants can be incorporated into the detergent compositions hereof. These surfactants can be broadly described as aliphatic derivatives of secondary or tertiary amines, or aliphatic derivatives of heterocyclic secondary and tertiary amines in which the aliphatic radical can be straight chain or branched. One of the aliphatic substituents contains at least about 8 carbon atoms, typically from about 8 to about 18 carbon atoms, and at least one contains an anionic water-solubilizing group, e.g., carboxy, sulfonate, sulfate. See U.S. Pat. No. 3,929,678 to Laughlin et al., issued Dec. 30, 1975 at column 19, lines 18–35 (herein incorporated by reference) for examples of ampholytic surfactants.

Zwitterionic surfactants can also be incorporated into the detergent compositions hereof. These surfactants can be broadly described as derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48 (herein incorporated by reference) for examples of zwitterionic surfactants.

Ampholytic and zwitterionic surfactants are generally used in combination with one or more anionic and/or nonionic surfactants.

Optical Brightener Component

The optical brighteners of the present invention are substantive to textiles being washed and sometimes are of comparatively low solubilities. Accordingly, it is important that they be maintained in solution in the liquid detergent composition and, even more important, they must be immediately dispersed in the washed water so as to avoid producing a wash containing noticeable brightened spots, rather than a uniformly bright appearance.

The choice of optical brighteners for use in detergent compositions will depend upon a number of factors, such as the type of detergent, the nature of other components present in the detergent composition, the temperature of the wash water, the degree of agitation, and the ratio of the material washed to the tub size.

The brightener selection is also dependent upon the type of material to be cleaned, e.g., cottons, synthetics, etc. Since most laundry detergent products are used to clean a variety of fabrics, the detergent compositions should contain a mixture of brighteners which are effective for a variety of fabrics. It is of course necessary that the individual components of such a brightener mixture be compatible.

Optical brighteners useful in the present invention are commercially available and will be appreciated by those skilled in the art. Commercial optical brighteners which may be useful in the present invention can be classified into subgroups which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

Certain derivatives of bis(triazinyl)aminostilbene which may be useful in the present invention may be prepared from 4,4'-diamine-stilbene-2,2'-disulfonic acid. Examples of such derivatives include, but are not limited to, those compounds disclosed at pages 39–42 of the Zahradnik reference which have the general formula

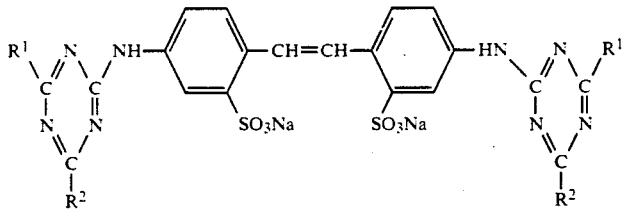

wherein $R^1$ and $R^2$ are each selected from, respectively, Cl and $N(CH_2CH_2OH)_2$; $NH_2$ and $NHCH_2CH_2OH$; $N(CH_3)CH_2CH_2SO_3H$ and $N(CH_2CH_2OH)_2$; $NH_2$ and $NHC_6H_5$; $NHCH_2CH_2OH$ and $NHC_6H_5$; $N(CH_2CH_2OH)_2$ and $NHC_6H_5$; $N(CH_2CH_2OH)_2$ and $NHC_6H_4SO_3H$ (1,3); $N(CH_2CH_2OH)_2$ and $NHC_6H_3(SO_3H)_2$ (1,2,4); $N(CH_3)CH_2CH_2SO_3H$ and $NHC_6H_4SO_3H$ (1,3); $NHC_6H_5$ and $NHC_6H_5$; $NHC_6H_4SO_3H$ (1,4) and $NHC_6H_4SO_3H$ (1,4); $NHC_6H_5$ and morpholino; $NHC_6H_3(SO_3H)_2$ (1,2,4) and morpholino; $NHCH_2CH_2SO_3H$ and $NHC_6H_3(SO_3H)_2$ (1,2,4); $OCH_3$ and $N(CH_2CH_2OH)_2$; $OCH_3$ and $N(CH_3)CH_2CH_2SO_3H$; OH and $NHC_6H_5$; $OCH_3$ and $NHC_6H_5$; $NHC_6H_5$ and $NHC_6H_4SO_3H$ (1,3); and $OCH_3$ and $NHCH_3$. $R^1$ and $R^2$ may also be individually selected from chloro, bromo, hydroxy, $C_1$–$C_4$ alkoxy, phenoxy, methyl-phenoxy, hydroxyoxaalkylamino, piperidino, pyrrolidino, analino, substituted anilino, amino, aliphatic amine, heterocyclic amine, and thio groups.

Examples of other stilbene derivatives which may be useful as optical brighteners in the present invention can be found under the heading "Brighteners, Optical", in *The Kirk-Othmer Encyclopedia of Chemical Technology*, Volume 3, pp. 737–750 (1962), the disclosure of which is incorporated herein by reference.

Examples of pyrazoline derivatives which may be useful in the present invention include, but are not necessarily limited to, those disclosed on pages 59–62 of the Zahradnik reference.

Coumarin derivatives which may be useful in the present invention include, but are not necessarily limited to, derivatives substituted in the 3-position, in the 7-position, and in both the 3- and 7-positions. Examples of coumarin derivatives substituted in the 3-position include, but are not necessarily limited to, those disclosed on pages 63–64 of the Zahradnik reference. Examples of coumarin derivatives substituted in the 7-position include, but are not necessarily limited to, those disclosed on pages 64–66 of the Zahradnik reference. Examples of coumarin derivatives substituted in both the 3- and 7-positions include, but are not necessarily limited to, those disclosed on pages 66–71 of the Zahradnik reference. Other examples of coumarin derivatives which may be useful in the present invention are disclosed at pages 744–745 of the Kirk-Othmer reference.

Carboxylic acid derivatives which may be useful as optical brighteners in the present invention include, but are not necessarily limited to, fumaric acid derivatives; benzoic acid derivatives; *p*-phenylene-bis-acrylic acid derivatives; naphthalenedicarboxylic acid derivatives; heterocyclic acid derivatives; and cinnamic acid derivatives.

Examples of fumaric acid derivatives which may be useful in the present invention include, but are not necessarily limited to, those disclosed at pages 72–74 of the Zahradnik reference. Examples of benzoic acid derivatives which may be useful in the present invention include, but are not necessarily limited to, those disclosed on pages 75–77 of the Zahradnik reference. Examples of ρ-phenylene-bis-acrylic acid derivatives, naphthalenedicarboxylic acid derivatives, and heterocyclic acid derivatives which may be useful in the present invention include, but are not necessarily limited to, those disclosed on pages 84–91 of the Zahradnik reference.

Cinnamic acid derivatives which may be useful as optical brighteners in the present invention can be further subclassified into groups which include, but are not necessarily limited to, styrylazoles, styrylbenzofurans, styryloxadiazoles, styryltriazoles, and styrylpolyphenyls, as disclosed on page 77 of the Zahradnik reference. Styrylazoles can be further subclassified into styrylbenzoxazoles, styrylimidazoles and styrylthiazoles, as disclosed on page 78 of the Zahradnik reference. It will be understood that these three identified subclasses may not necessarily reflect an exhaustive list of the subgroups into which styrylazoles may be subclassified.

Examples of cinnamic acid derivatives which may be useful in the present invention include, but are not necessarily limited to, those disclosed on pages 77–78 of the Zahradnik reference.

Examples of styrylbenzoxazole derivatives, 2-styrylbenzimidazole derivatives, styrylbenzofuran derivatives, styryloxadiazole derivatives, and styrylpolyphenyl derivatives which may be useful in the present invention include, but are not necessarily limited to, those disclosed on pages 78–83 of the Zahradnik reference.

Methinecyanine derivatives which may be useful as optical brighteners in the present invention include, but are not necessarily limited to, those disclosed at pages 91–93 of the Zahradnik reference. Examples of these types of brighteners include oxamethinecyanines and thiamethinecyanines.

Another class of brighteners which may be useful in the present invention are the derivatives of dibenzothiophene-5,5-dioxide disclosed on pages 741–749 of the Kirk-Othmer reference. Examples of such brighteners include, but are not necessarily limited to, 3,7-diaminodibenzothiophene-2,8-disulfonic acid 5,5 dioxide.

Still another class of brighteners which may be useful in the present invention include azoles, which are derivatives of 5-membered ring heterocycles. These can be further subcategorized into monoazoles and bisazoles. Examples of monoazoles are disclosed at pages 741–743 of the Kirk-Othmer reference. Examples of bisazoles which may be useful in the present invention are disclosed at pages 743–744 of the Kirk-Othmer reference.

An additional class of brighteners which may be useful in the present invention are the derivatives of 6-membered-ring hetero-cycles disclosed on page 745 of the Kirk-Othmer reference. Examples of such compounds include brighteners derived from pyrazine and brighteners derived from 4-aminonaphthalamide.

In addition to the brighteners already described, miscellaneous agents may also be useful as brighteners. Examples of some of these miscellaneous agents are disclosed at pages 93–95 of the Zahradnik reference, and include 1-hydroxy-3,6,8-pyrenetrisulfonic acid; 2,4-dimethoxy-1,3,5-triazin-6-yl-pyrene; 4,5-diphenylimidazolonedisulfonic acid; and derivatives of pyrazoline-quinoline.

Other examples of optical brighteners which may be useful in the present invention are those disclosed in U.S. Pat. No. 4,790,856, issued to Wixon on Dec. 13, 1988, the disclosure of which is incorporated herein by reference. These brighteners include the following Phorwhites from Verona: BHC, BKL, BUP, BBH solution, BRN solution, DCR liquid, DCBVF, EV liquid, DBS liquid and ANR. Other brighteners disclosed in this reference include, Tinopal UNPA, Tinopal CBS and Tinopal 5BM, available from Ciba-Geigy, located in Switzerland; Arctic White CC and Artic White CWD, available from Hilton-Davis, located in Italy; the 2-(4-styryl-phenyl)-2H-naphthol-[1,2-d]triazoles; 4,4'-bis(1,2,3-triazol-2-yl)-stilbenes; 4,4'-bis-(styryl)bisphenyls; and the y-aminocoumarins. Specific examples of these brighteners include 4-methyl-7-diethyl-amino coumarin; 1,2-bis(-benzimidazol-2-yl)ethylene; 1,3-diphenylphrazolines; 2,5-bis(benzoxazol-2-yl)thiophene; 2-styryl-naphth-[1,2-d]oxazole; and 2-(stilbene-4-yl)2H-naphth-[1,2-d]triazole.

Other optical brighteners which may be useful in the present invention include those disclosed in U.S. Pat. No. 3,646,015, issued Feb. 29, 1972 to Hamilton, the disclosure of which is incorporated herein by reference, and those disclosed in U.S. Pat. No. 4,483,780, issued Nov. 20, 1984 to Llenado, the disclosure of which is incorporated herein by reference.

Anionic optical brighteners are preferred in the present invention. More preferred are the brighteners having the following structures:

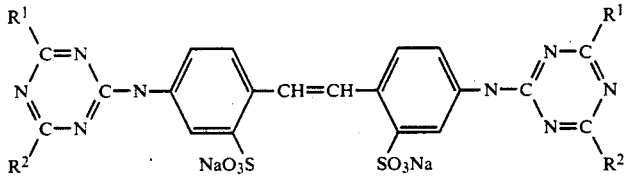

(I)

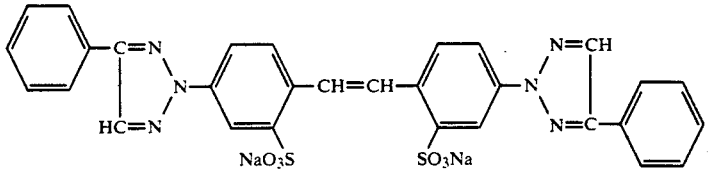

(II)

-continued

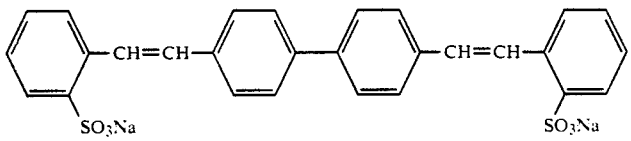

(III)

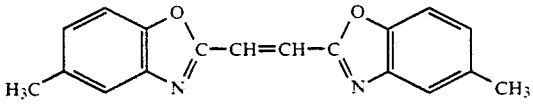

(IV)

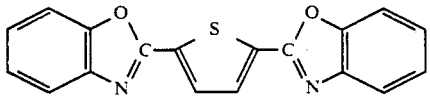

(V)

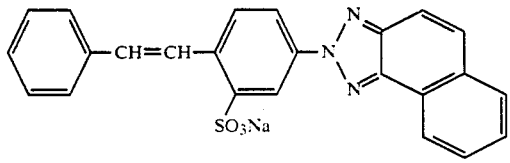

(VI)

and mixtures thereof, wherein $R^1$ is $—NHC_6H_5$ and $R^2$ is selected from $—N(CH_2CH_2OH)_2$, $—N(CH_3)CH_2CH_2OH$, $—NHC_6H_5$ and a morpholino group.

Most preferred are the compounds having the structures I, III, and VI.

Polyhydroxy Fatty Acid Amide

The polyhydroxy fatty acid amide surfactant component of the present invention comprises compounds of the structural formula:

$$R^2—\overset{O}{C}—\overset{R^1}{N}—Z \qquad (I)$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z is a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2OH$, $—CH_2—(CHOH)_2(CHOR')(CHOH)—CH_2OH$, where n is an integer from 3 to 5, inclusive, and R' is H or a cyclic or aliphatic monosaccharide, and alkoxylated derivatives thereof. Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-2-hydroxy ethyl, or N-2-hydroxy propyl.

$R^2—CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

The most preferred polyhydroxy fatty acid amide has the general formula $$R^2—\overset{O}{\overset{\|}{C}}—\overset{CH_3}{\overset{|}{N}}—CH_2—(CHOH)_4CH_2OH$$

wherein $R^2$ is a $C_{11}$–$C_{17}$ straight-chain alkyl or alkenyl group.

Methods for making polyhydroxy fatty acid amides are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed, for example, in G.B. Patent Specification 809,060, published Feb. 18, 1959, by Thomas Hedley & Co., Ltd., U.S. Pat. No. 2,965,576, issued Dec. 20, 1960 to E. R. Wilson, and U.S. Pat. No. 2,703,798, Anthony M. Schwartz, issued Mar. 8, 1955, and U.S. Pat. No. 1,985,424, issued Dec. 25, 1934 to Piggott, each of which is incorporated herein by reference.

In one process for producing N-alkyl or N-hydroxyalkyl, N-deoxyglycityl fatty acid amides wherein the glycityl component is derived from glucose and the N-alkyl or N-hydroxyalkyl functionality is N-methyl, N-ethyl, N-propyl, N-butyl, N-hydroxyethyl, or N-hydroxypropyl, the product is made by reacting N-alkyl- or N-hydroxyalkyl-glucamine with a fatty ester selected from fatty methyl esters, fatty ethyl esters, and fatty triglycerides in the presence of a catalyst selected from the group consisting of trilithium phosphate, trisodium phosphate, tripotassium phosphate, tetrasodium pyrophosphate, pentapotassium tripolyphosphate, lithium hydroxide, sodium hydroxide, potassium hydroxide, calcium hydroxide, lithium carbonate, sodium carbonate, potassium carbonate, disodium tartrate, dipotassium tartrate, sodium potassium tartrate, trisodium citrate, tripotassium citrate, sodium basic silicates, potassium basic silicates, sodium basic aluminosilicates, and potassium basic aluminosilicates, and mixtures thereof. The amount of catalyst is preferably from about 0.5 mole % to about 50 mole %, more preferably from about 2.0 mole % to about 10 mole %, on an N-alkyl or N-hydroxyalkyl-glucamine molar basis. The reaction is preferably carried out at from about 138° C. to about 170° C. for typically from about 20 to about 90 minutes. When triglycerides are utilized in the reaction mixture as the fatty ester source, the reaction is also preferably carried out using from about 1 to about 10 weight % of a phase transfer agent, calculated on a weight percent basis of total reaction mixture, selected from saturated fatty alcohol polyethoxylates, alkylpolyglycosides, linear glycamide surfactant, and mixtures thereof.

Preferably, this process is carried out as follows:

(a) preheating the fatty ester to about 138° C. to about 170° C.;

(b) adding the N-alkyl or N-hydroxyalkyl glucamine to the heated fatty acid ester and mixing to the extent needed to form a two-phase liquid/liquid mixture;

(c) mixing the catalyst into the reaction mixture; and (d) stirring for the specified reaction time.

Also preferably, from about 2% to about 20% of preformed linear N-alkyl/N-hydroxyalkyl, N-linear glucosyl fatty acid amide product is added to the reaction mixture, by weight of the reactants, as the phase transfer agent if the fatty ester is a triglyceride. This seeds the reaction, thereby increasing reaction rate. A detailed experimental procedure is provided below in the Experimental.

The polyhydroxy "fatty acid" amide materials used herein also offer the advantages to the detergent formulator that they can be prepared wholly or primarily from natural, renewable, nonpetrochemical feedstocks and are degradable. They also exhibit low toxicity to aquatic life.

It should be recognized that along with the polyhydroxy fatty acid amides of Formula (I), the processes used to produce them will also typically produce quantities of nonvolatile by-product such as esteramides and cyclic polyhydroxy fatty acid amide. The level of these by-products will vary depending upon the particular reactants and process conditions. Preferably, the polyhydroxy fatty acid amide incorporated into the detergent compositions hereof will be provided in a form such that the polyhydroxy fatty acid amide-containing composition added to the detergent contains less than about 10%, preferably less than about 4%, of cyclic polyhydroxy fatty acid amide. The preferred processes described above are advantageous in that they can yield rather low levels of by-products, including such cyclic amide by-product.

Builders

The detergent compositions of the present invention comprise inorganic or organic detergent builders to assist in mineral hardness control.

Inorganic detergent builders include, but are not limited to, the alkali metal, ammonium and alkanolammonium salts of polyphosphates (exemplified by the tripolyphosphates, pyrophosphates, and glassy polymeric meta-phosphates), phosphonates, silicates, carbonates (including bicarbonates and sesquicarbonates), sulfates, and aluminosilicates. Borate builders, as well as builders containing borate-forming materials that can produce borate under detergent storage or wash conditions, can be used but preferably are not used in the compositions of the invention.

Examples of silicate builders are the alkali metal silicates, particularly those having a $SiO_2$:$Na_2O$ ratio in the range 1.6:1 to 3.2:1. However, other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates, including sodium carbonate and sesquicarbonate and mixtures thereof with ultrafine calcium carbonate as disclosed in German Patent Application No. 2,321,001 published on Nov. 15, 1973, the disclosure of which is incorporated herein by reference.

Aluminosilicate builders are especially useful in the present invention. Aluminosilicate builders are of great importance in most currently marketed heavy duty granular detergent compositions, and can also be a significant builder ingredient in liquid detergent formulations. Aluminosilicate builders include those having the formula:

$$Na_z[(AlO_2)_z(SiO_2)_y]\cdot xH_2O$$

wherein z and y are integers of at least 6, the molar ratio of z to y is in the range from 1.0 to about 0.5, and x is an integer from about 15 to about 264. Preferred amorphous hydrated aluminosilicate materials have the empirical formula:

$$M_z(zAlO_2\cdot ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al., issued Oct. 12, 1976, incorporated herein by reference. Preferred synthetic crystalline aluminosilicate ion exchange materials useful herein are available under the designations Zeolite A, Zeolite P (B), and Zeolite X. In an especially preferred embodiment, the crystalline aluminosilicate ion exchange material has the formula:

$$Na_{12}(AlO_2)_{12}(SiO_2)_{12}]\cdot xH_2O$$

wherein x is from about 20 to about 30, especially about 27.

Specific examples of polyphosphates are the alkali metal tripolyphosphates, sodium, potassium and ammonium pyrophosphate, sodium and potassium and ammonium pyrophosphate, sodium and potassium orthophosphate, sodium polymeta phosphate in which the degree of polymerization ranges from about 6 to about 21. Particularly preferred are the alkali metal tripoly- and pyro- phosphates.

Examples of phosphonate builder salts are the water-soluble salts of ethane 1-hydroxy-1,1-diphosphonate particularly the sodium and potassium salts, the water-soluble salts of methylene diphosphonic acid e.g. the trisodium and tripotassium salts and the water-soluble salts of substituted methylene diphosphonic acids, such as the trisodium and tripotassium ethylidene, isopyropylidene benzylmethylidene and halo methylidene phosphonates. Phosphonate builder salts of the aforementioned types are disclosed in U.S. Pat. Nos. 3,159,581 and 3,213,030 issued Dec. 1, 1964 and Oct. 19, 1965, to Diehl; U.S. Pat. No. 3,422,021 issued Jan. 14, 1969, to Roy; and U.S. Pat. Nos. 3,400,148 and 3,422,137 issued Sept. 3, 1968, and Jan. 14, 1969 to Quimby, said disclosures being incorporated herein by reference.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates.

Included among the polycarboxylate builders are a variety of categories of useful materials. One important category of polycarboxylate builders encompasses the ether polycarboxylates. A number of ether polycarboxylates have been disclosed for use as detergent builders. Examples of useful ether polycarboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972, both of which are incorporated herein by reference.

A specific type of ether polycarboxylates useful as builders in the present invention also include those having the general formula:

$$CH(A)(COOX)—CH(COOX)—O—CH(COOX)—CH(COOX)(B)$$

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

$$HO—[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Still other ether polycarboxylates include copolymers of maleic anhydride with ethylene or vinyl methyl ether, 1, 3, 5-trihydroxy benzene-2, 4, 6-trisulfonic acid, and carboxy-methyloxysuccinic acid.

Organic polycarboxylate builders also include the various alkali metal, ammonium and substituted ammonium polyacetates. Examples of polyacetate builders are the sodium, potassium, lithium, ammonium and substituted ammonium salts of ethylenediamine tetraacetic acid, nitrilotriacetic acid, and mellitic acid.

Also included are polycarboxylates such as mellitic acid, tartaric acid, itaconic acid, succinic acid, oxydisuccinic acid, maleic acid, polymaleic acid, benzene 1,3,5-tricarboxylic acid, and carboxymethyloxysuccinic acid.

Citric builders, e.g., citric acid, polycarboxylate builder of particular importance for heavy duty liquid detergent formulations, but can also be used in granular compositions.

Other carboxylate builders include the carboxylated carbohydrates disclosed in U.S. Pat. No. 3,723,322, Diehl, issued Mar. 28, 1973, incorporated herein by reference.

Polycarboxylate builder can generally be added to the composition in acid form, but can also be added in the form of a neutralized salt. When utilized in salt form, alkali metals or alkanolammonium salts are preferred.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference. Useful succinic acid builders include the $C_5$–$C_{20}$ alkyl succinic acids and salts thereof. A particularly preferred compound of this type is dodecenylsuccinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: lauryl succinate, myristyl succinate, palmityl succinate, 2-dodecenyl succinate (preferred), 2-pentadecenyl succinate, and the like.

Examples of useful builders also include sodium and potassium carboxy-methyloxmalonate, carboxmethyloxysuccinate, cis-cyclohexanehexacarboxylate, cis-cyclopentane-tetracarboxylate phloroglucinol tri-sulfonate, water-soluble polyacrylates (these polyacrylates having molecular weights to above about 2,000 can also be effectively utilized as dispersants), and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a surfactant.

Polycarboxylate builders are also disclosed in U.S. Pat. No. 3,308,067, Diehl, issued Mar. 7, 1967, incorporated herein by reference. Such materials include the water-soluble salts of homoand copolymers of aliphatic carboxylic acids such as maleic acid, itaconic acid, mesaconic acid, fumaric acid, aconitic acid, citraconic acid and methylenemalonic acid.

Liquid Carrier

The detergent compositions of the present invention comprise a liquid carrier, e.g., water, preferably a mixture of water and a $C_1$–$C_4$ monohydric alcohol (e.g., ethanol, propanol, isopropanol, butanol, and mixtures thereof), with ethanol being the preferred alcohol.

Optional Ingredients

Bleaching Compounds—Bleaching Agents and Bleach Activators

The detergent compositions hereof may contain bleaching agents or bleaching compositions containing bleaching agent and one or more bleach activators. When present bleaching compounds will typically be present at levels of from about 1% to about 20%, more typically from about 1% to about 10%, of the detergent composition. In general, bleaching compounds are optional components in non-liquid formulations, e.g., granular detergents. If present, the amount of bleach activators will typically be from about 0.1% to about 60%, more typically from about 0.5% to about 40% of the bleaching composition.

The bleaching agents used herein can be any of the bleaching agents useful for detergent compositions in textile cleaning, hard surface cleaning, or other cleaning purposes that are now known or become known. These include oxygen bleaches as well as other bleaching agents. For wash conditions below about 50° C., especially below about 40° C., it is preferred that the compositions hereof not contain borate or material which can form borate in situ (i.e. borate-forming material) under detergent storage or wash conditions. Thus it is preferred under these conditions that a non-borate, non-borate-forming bleaching agent is used. Preferably, detergents to be used at these temperatures are substantially free of borate and borate-forming material. As used herein, "substantially free of borate and borate-forming material" shall mean that the composition contains not more than about 2% by weight of borate-containing and borate-forming material of any type, preferably, no more than 1%, more preferably 0%.

One category of bleaching agent that can be used encompasses percarboxylic acid bleaching agents and salts thereof. Suitable examples of this class of agents include magnesium monoperoxyphthalate hexahydrate, the magnesium salt of meta-chloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application No. 740,446, Burns et al., filed June 3, 1985, European Patent Application 0,133,354, Banks et al., published Feb. 20, 1985, and U.S. Pat. No. 4,412,934, Chung et al., issued Nov. 1, 1983, all of which are incorporated by reference herein. Highly preferred bleaching agents also include 6-nonylamino-6-oxoperoxycaproic acid as described in U.S. Pat. No. 4,634,551, issued Jan. 6, 1987 to Burns, et al., incorporated herein by reference.

Another category of bleaching agents that can be used encompasses the halogen bleaching agents. Examples of hypohalite bleaching agents, for example, include trichloro isocyanuric acid and the sodium and potassium dichloroisocyanurates and N-chloro and N-bromo alkane sulfonamides. Such materials are normally added at 0.5–10% by weight of the finished product, preferably 1–5% by weight.

Peroxygen bleaching agents can also be used. Suitable peroxygen bleaching compounds include sodium carbonate peroxyhydrate, sodium pyrophosphate peroxyhydrate, urea peroxyhydrate, and sodium peroxide.

Peroxygen bleaching agents are preferably combined with bleach activators, which lead to the in situ production in aqueous solution (i.e., during the washing process) of the peroxy acid corresponding to the bleach activator.

Preferred bleach activators incorporated into compositions of the present invention have the general formula:

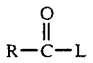

wherein R is an alkyl group containing from about 1 to about 18 carbon atoms wherein the longest linear alkyl chain extending from and including the carbonyl carbon contains from about 6 to about 10 carbon atoms and L is a leaving group, the conjugate acid of which has a $pK_a$ in the range of from about 4 to about 13. These bleach activators are described in U.S. Pat. No. 4,915,854, issued Apr. 10, 1990 to Mao, et al., incorporated herein by reference, and U.S. Pat. No. 4,412,934, which was previously incorporated herein by reference.

Bleaching agents other than oxygen bleaching agents are also known in the art and can be utilized herein. One type of non-oxygen bleaching agent of particular interest includes photo-activated bleaching agents such as the sulfonated zinc and/or aluminum phthalocyanines. These materials can be deposited upon the substrate during the washing process. Upon irradiation with light, in the presence of oxygen, such as by hanging clothes out to dry in the daylight, the sulfonated zinc phthalocyanine is activated and, consequently, the substrate is bleached. Preferred zinc phthalocyanine and a photoactivated bleaching process are described in U.S. Pat. No. 4,033,718, issued July 5, 1977 to Holcombe et al., incorporated herein by reference. Typically, detergent compositions will contain about 0.025% to about 1.25%, by weight, of sulfonated zinc phthalocyanine.

Polymeric Soil Release Agent

Any polymeric soil release agents known to those skilled in the art can be employed in the practice of this invention. Polymeric soil release agents are characterized by having both hydrophilic segments, to hydrophilize the surface of hydrophobic fibers, such as polyester and nylon, and hydrophobic segments, to deposit upon hydrophobic fibers and remain adhered thereto through completion of washing and rinsing cycles and, thus, serve as an anchor for the hydrophilic segments. This can enable stains occurring subsequent to treatment with the soil release agent to be more easily cleaned in later washing procedures.

Polymeric soil release agents useful in the present invention include cellulosic derivatives such as hydroxyether cellulosic polymers, copolymeric blocks of ethylene terephthalate or propylene terephthalate with polyethylene oxide or polypropylene oxide terephthalate, and the like.

Cellulosic derivatives that are functional as soil release agents are commercially available and include hydroxyethers of cellulose such as Methocel ® (Dow).

Cellulosic soil release agents for use herein also include those selected from the group consisting of $C_1$–$C_4$ alkyl and $C_4$ hydroxyalkyl cellulose such as methylcellulose, ethylcellulose, hydroxypropyl methylcellulose, and hydroxybutyl methylcellulose. A variety of cellulose derivatives useful as soil release polymers are disclosed in U.S. Pat. No. 4,000,093, issued Dec. 28, 1976 to Nicol, et al., incorporated herein by reference.

Soil release agents characterized by poly(vinyl ester) hydrophobe segments include graft copolymers of poly(vinyl ester), e.g., $C_1$–$C_6$ vinyl esters, preferably poly(vinyl acetate) grafted onto polyalkylene oxide backbones, such as polyethylene oxide backbones. Such materials are known in the art and are described in European Patent Application 0 219 048, published Apr. 22, 1987 by Kud, et al. Suitable commercially available soil release agents of this kind include the Sokalan TM type of material, e.g., Sokalan TM HP-22, available from BASF (West Germany).

One type of preferred soil release agent is a copolymer having random blocks of ethylene terephthalate and polyethylene oxide (PEO) terephthalate. More specifically, these polymers are comprised of repeating units of ethylene terephthalate and PEO terephthalate in a mole ratio of ethylene terephthalate units to PEO terephthalate units of from about 25:75 to about 35:65, said PEO terephthalate units containing polyethylene oxide having molecular weights of from about 300 to about 2000. The molecular weight of this polymeric soil release agent is in the range of from about 25,000 to about 55,000. See U.S. Pat. No. 3,959,230 to Hays, issued May 25, 1976, which is incorporated by reference. See also U.S. Pat. No. 3,893,929 to Basadur issued July 8, 1975 (incorporated by reference) which discloses similar copolymers.

Another preferred polymeric soil release agent is a polyester with repeat units of ethylene terephthalate units containing 10–15% by weight of ethylene terephthalate units together with 90–80% by weight of polyoxyethylene terephthalate units, derived from a polyoxyethylene glycol of average molecular weight 300–5,000, and the mole ratio of ethylene terephthalate units to polyoxyethylene terephthalate units in the polymeric compound is between 2:1 and 6:1. Examples of this polymer include the commercially available material Zelcon ® 5126 (from Dupont) and Milease$^R$ T (from ICI). These polymers and methods of their preparation are more fully described in U.S. Pat. No. 4,702,857, issued Oct. 27, 1987 to Gosselink, which is incorporated herein by reference.

Another preferred polymeric soil release agent is a sulfonated product of a substantially linear ester oligomer comprised of an oligomeric ester backbone of terephthaloyl and oxyalkyleneoxy repeat units and terminal moieties covalently attached to the backbone, said soil release agent being derived from allyl alcohol ethoxylate, dimethylterephthalate, and 1,2 propylene diol, wherein the terminal moieties of each oligomer have, on average, a total of from about 1 to about 4 sulfonate groups. These soil release agents are described fully in U.S. Pat. No. 4,968,451, issued Nov. 6, 1990, to J. J. Scheibel and E. P. Gosselink, U.S. Ser. No. 07/474,709, filed Jan. 29, 1990, incorporated herein by reference.

Other suitable polymeric soil release agents include the ethyl- or methyl-capped 1,2-propylene terephthalate-polyoxy- ethylene terephthalate polyesters of U.S. Pat. No. 4,711,730, issued Dec. 8, 1987 to Gosselink et al., the anionic end-capped oligomeric esters of U.S. Pat. No. 4,721,580, issued Jan. 26, 1988 to Gosselink, wherein the anionic end-caps comprise sulfo-polyethoxy groups derived from polyethylene glycol (PEG), the block polyester oligomeric compounds of U.S. Pat. No. 4,702,857, issued Oct. 27, 1987 to Gosselink, having polyethoxy end-caps of the formula $X\text{-}(OCH_2CH_2)_n$— wherein n is from 12 to about 43 and X is a $C_1$–$C_4$ alkyl, or preferably methyl, all of these patents being incorporated herein by reference.

Additional soil release polymers include the soil release polymers of U.S. Pat. No. 4,877,896, issued Oct. 31, 1989 to Maldonado et al., which discloses anionic, especially sulfoaroyl, end-capped terephthalate esters, said patent being incorporated herein by reference. The terephthalate esters contain unsymmetrically substituted oxy-1,2-alkyleneoxy units. Included among the soil release polymers of U.S. Pat. No. 4,877,896 are materials with polyoxyethylene hydrophile components or $C_3$ oxyalkylene terephthalate (propylene terephthalate) repeat units within the scope of the hydrophobe components of (b)(i) above. It is the soil release polymers characterized by either, or both, of these criteria that particularly benefit from the inclusion of the polyhydroxy fatty acid amides hereof, in the presence of anionic surfactants.

If utilized, soil release agents will generally comprise from about 0.01% to about 10.0%, preferably from about 0.1% to about 5.0%, more preferably from about 0.2% to about 3.0% by weight of the detergent compositions herein.

Chelating Agents

The detergent compositions herein may also optionally contain one or more iron and manganese chelating agents as a builder adjunct material. Such chelating agents can be selected from the group consisting of amino carboxylates, amino phosphonates, polyfunctionally-substituted aromatic chelating agents and mixtures thereof, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents in compositions of the invention can have one or more, preferably at least two, units of the substructure

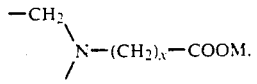

wherein M is hydrogen, alkali metal, ammonium or substituted ammonium (e.g. ethanolamine) and x is from 1 to about 3, preferably 1. Preferably, these amino carboxylates do not contain alkyl or alkenyl groups with more than about 6 carbon atoms. Operable amine carboxylates include ethylenediaminetetraacetates, N-hydroxyethylethylenediaminetriacetates, nitrilotriacetates, ethylenediamine tetraproprionates, triethylenetetraaminehexaacetates, diethylenetriaminepentaacetates, and ethanoldiglycines, alkali metal, ammonium, and substituted ammonium salts thereof and mixtures thereof.

Amino phosphonates are also suitable for use as chelating agents in the compositions of the invention when at least low levels of total phosphorus are permitted in detergent compositions. Compounds with one or more, preferably at least two, units of the substructure

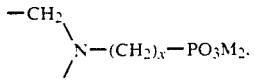

wherein M is hydrogen, alkali metal, ammonium or substituted ammonium and x is from 1 to about 3, preferably 1, are useful and include ethylenediaminetetrakis (methylenephosphonates), nitrilotris (methylenephosphonates) and diethylenetriaminepentakis (methylenephosphonates). Preferably, these amino phosphonates do not contain alkyl or alkenyl groups with more than about 6 carbon atoms. Alkylene groups can be shared by substructures.

Polyfunctionally-substituted aromatic chelating agents are also useful in the compositions herein. These materials can comprise compounds having the general formula

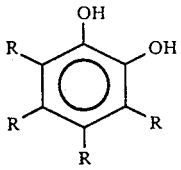

wherein at least one R is —$SO_3H$ or —COOH or soluble salts thereof and mixtures thereof. U.S. Pat. No. 3,812,044, issued May 21, 1974, to Connor et al., incorporated herein by reference, discloses polyfunctionally - substituted aromatic chelating and sequestering agents. Preferred compounds of this type in acid form are dihydroxydisulfobenzenes such as 1,2-dihydroxy-3,5-disulfobenzene. Alkaline detergent compositions can contain these materials in the form of alkali metal, ammonium or substituted ammonium (e.g. mono-or triethanol-amine) salts.

If utilized, these chelating agents will generally comprise from about 0.1% to about 10% by weight of the detergent compositions herein. More preferably chelating agents will comprise from about 0.1% to about 3.0% by weight of such compositions.

Clay Soil Removal/Anti-redeposition Agents

The compositions of the present invention can also optionally contain water-soluble ethoxylated amines having clay soil removal and anti-redeposition properties. Examples of such agents include polyethylene glycols and water-soluble ethoxylated amines having clay soil removal and anti-redeposition properties.

Polyethylene glycol compounds useful in the compositions of the present invention typically have a molecular weight in the range of from about 400 to about 100,000, preferably from about 1,000 to about 20,000, more preferably from about 2,000 to about 12,000, most preferably from about 4,000 to about 8,000. Such compounds are commercially available and are sold as Carbowax $^R$, which is available from Union Carbide, located in Danbury, Conn.

The water-soluble ethoxylated amines are preferably selected from the group consisting of:

(1) ethoxylated monoamines having the formula:

(2) ethoxylated diamines having the formula:

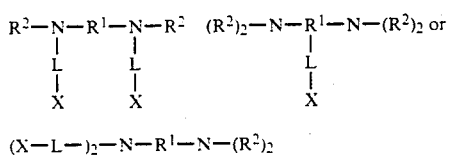

(3) ethoxylated polyamines having the formula:

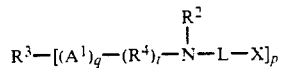

(4) ethoxylatd amine polymers having the general formula:

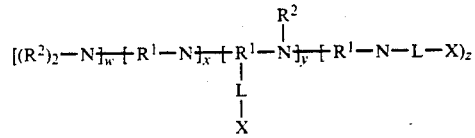

(5) mixtures thereof; wherein $A^1$ is

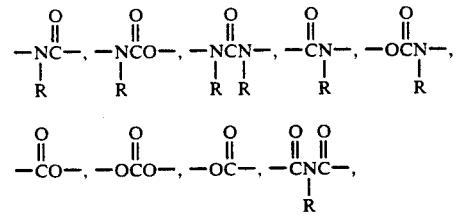

or —O—; R is H or $C_1$–$C_4$ alkyl or hydroxyalkyl; $R^1$ is $C_2$–$C_{12}$- alkylene, hydroxyalkylene, alkenylene, arylene or alkarylene, or a $C_2$–$C_3$ oxyalkylene moiety having from 2 to about 20 oxyalkylene units provided that no O-N bonds are formed; each $R^2$ is $C_1$–$C_4$or hydroxyalkyl, the moiety —L—X, or two $R^2$ together form the moiety $-(CH_2)_r-A^2-(CH_2)_s-$, wherein $A^2$ is —O— or $-CH_2-$, r is 1 or 2, s is 1 or 2, and r+s is 3 or 4; X is a nonionic group, an anionic group or mixture thereof; $R^3$ is a substituted $C_3$-$C_{12}$ alkyl, hydroxyalkyl, alkenyl, aryl, or alkaryl group having substitution sites; $R^4$ is $C_1$-$C_{12}$ alkylene, hydroxyalkylene, alkenylene, arylene or alkarylene, or a $C_2$-$C_3$ oxyalkylene moiety having from 2 to about 20 oxyalkylene units provided that no O—O or O—N bonds are formed; L is a hydrophilic chain which contains the polyoxyalkylene moiety $-[(R^5O)_m-(CH_2CH_2O)_n]-$, wherein $R^5$ is $C_3$-$C_4$alkylene or hydroxyalkylene and m and n are numbers such that the moiety $-(CH_2CH_2O)_n-$ comprises at least about 50% by weight of said polyoxyalkylene moiety; for said monoamines, m is from 0 to about 4, and n is at least about 12; for said diamines, m is from 0 to about 3, and n is at least about 6 when $R^1$ is $C_2$-$C_3$ alkylene, hydroxyalkylene, or alkenylene, and at least about 3 when $R^1$ is other than $C_2$-$C_3$ alkylene, hydroxyalkylene or alkenylene; for said polyamines and amine polymers, m is from 0 to about 10 and n is at least about 3; p is from 3 to 8; q is 1 or 0; t is 1 or 0, provided that t is 1 when q is 1; w is 1 or 0; x+y+z is at least 2; and y+z is at least 2. The most preferred soil release and anti-redeposition agent is ethoxylated tetraethylenepentamine. Exemplary ethoxylated amines are further described in U.S. Pat. No. 4,597,898, VanderMeer, issued July 1, 1986, incorporated herein by reference. Another group of preferred clay soil removal/anti-redeposition agents are the cationic compounds disclosed in European Patent Application 111,965, Oh and Gosselink, published June 27, 1984, incorporated herein by reference. Other clay soil removal/anti-redeposition agents which can be used include the ethoxylated amine polymers disclosed in European Patent Application 111,984, Gosselink, published June 27, 1984; the zwitterionic polymers disclosed in European Patent Application 112,592, Gosselink, published July 4, 1984; and the amine oxides disclosed in U.S. Pat. No. 4,548,744, Connor, issued Oct. 22, 1985, all of which are incorporated herein by reference.

Granular detergent compositions which contain such compounds typically contain from about 0.01% to about 10.0% by weight of the clay-removal agent, liquid detergent compositions typically contain from about 0.01% to about 5% by weight.

Polymeric Dispersing Agents

Polymeric polycarboxylate dispersing agents can advantageously be utilized in the compositions hereof. These materials can aid in calcium and magnesium hardness control. In addition to acting as a builder adjunct analogously to the poly- carboxylate described above in the Builder description, it is believed, though it is not intended to be limited by theory, that these higher molecular weight dispersing agents can further enhance overall detergent builder performance by inhibiting crystal growth of inorganics, by particulate soil peptization, and by antiredepositions, when used in combination with other builders including lower molecular weight polycarboxylates.

The polycarboxylate materials which can be employed as the polymeric polycarboxylate dispersing agent component herein are these polymers or copolymers which contain at least about 60% by weight of segments with the general formula

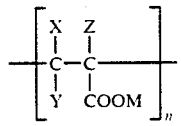

wherein X, Y, and Z are each selected from the group consisting of hydrogen, methyl, carboxy, carboxymethyl, hydroxy and hydroxymethyl; a salt-forming cation and n is from about 30 to about 400. Preferably, X is hydrogen or hydroxy, Y is hydrogen or carboxy, Z is hydrogen and M is hydrogen, alkali metal, ammonia or substituted ammonium.

Polymeric polycarboxylate materials of this type can be prepared by polymerizing or copolymerizing suitable unsaturated monomers, preferably in their acid form. Unsaturated monomeric acids that can be polymerized to form suitable polymeric polycarboxylates include acrylic acid, maleic acid (or maleic anhydride), fumaric acid, itaconic acid, aconitic acid, mesaconic acid, citraconic acid and methylenemalonic acid. The presence in the polymeric polycarboxylates herein of monomeric segments, containing no carboxylate radicals such as vinylmethyl ether, styrene, ethylene, etc. is suitable provided that such segments do not constitute more than about 40% by weight.

Particularly suitable polymeric polycarboxylates can be derived from acrylic acid. Such acrylic acid-based polymers which are useful herein are the water-soluble salts of polymerized acrylic acid. The average molecular weight of such polymers in the acid form ranges from about 2,000 to 10,000, more preferably from about 4,000 to 7,000 and most preferably from about 4,000 to 5,000. Water-soluble salts of such acrylic acid polymers can include, for example, the alkali metal, ammonium and substituted ammonium salts. Soluble polymers of this type are known materials. Use of polyacrylates of this type in detergent compositions has been disclosed, for example, in Diehl, U.S. Pat. No. 3,308,067, issued Mar. 7, 1967. This patent is incorporated herein by reference.

Acrylic/maleic-based copolymers may also be used as a preferred component of the dispersing agent. Such materials include the water-soluble salts of copolymers of acrylic acid and maleic acid. The average molecular weight of such copolymers in the acid form ranges from about 5,000 to 100,000, preferably from about 6,000 to 60,000, more preferably from about 7,000 to 60,000. The ratio of acrylate to maleate segments in such copolymers will generally range from about 30:1 to about 1:1, more preferably from about 10:1 to 2:1. Water-soluble salts of such acrylic acid/ maleic acid copolymers can include, for example, the alkali metal, ammonium and substituted ammonium salts. Soluble acrylate/maleate copolymers of this type are known materials which are described in European Patent Application No. 66915, published Dec. 15, 1982, which publication is incorporated herein by reference.

If utilized, the polymeric dispersing agents will generally comprise from about 0.2% to about 10%, preferably from about 1% to about 5% by weight of the detergent compositions herein.

Suds Suppressors

Compounds known, or which become known, for reducing or suppressing the formation of suds can be incorporated into the compositions of the present invention. The incorporation of such materials, hereinafter "suds suppressors," can be desirable because the polyhydroxy fatty acid amide surfactants hereof can increase suds stability of the detergent compositions. Suds suppression can be of particular importance when the detergent compositions include a relatively high sudsing surfactant in combination with the polyhydroxy fatty acid amide surfactant. Suds suppression is particularly desirable for compositions intended for use in front loading automatic washing machines. These machines are typically characterized by having drums, for containing the laundry and wash water, which have a horizontal axis and rotary action about the axis. This type of agitation can result in high suds formation and, consequently, in reduced cleaning performance. The use of suds suppressors can also be of particular importance under hot water washing conditions and under high surfactant concentration conditions.

A wide variety of materials may be used as suds suppressors in the compositions hereof. Suds suppressors are well known to those skilled in the art. They are generally described, for example, in Kirk Othmer Encyclopedia of Chemical Technology, Third Edition, Volume 7, pages 430–447 (John Wiley & Sons, Inc., 1979). One category of suds suppressor of particular interest encompasses monocarboxylic fatty acids and soluble salts thereof. These materials are discussed in U.S. Pat. No. 2,954,347, issued Sept. 27, 1960 to Wayne St. John, said patent being incorporated herein by reference. The monocarboxylic fatty acids, and salts thereof, for use as suds suppressor typically have hydrocarbyl chains of 10 to about 24 carbon atoms, preferably 12 to 18 carbon atoms. Suitable salts include the alkali metal salts such as sodium, potassium, and lithium salts, and ammonium and alkanolammonium salts. These materials are a preferred category of suds suppressor for detergent compositions.

The detergent compositions may also contain non-surfactant suds suppressors. These include, for example, high molecular weight hydrocarbons such as paraffin, fatty acid esters (e.g., fatty acid triglycerides), fatty acid esters of monovalent alcohols, aliphatic $C_{18}$–$C_{40}$ ketones (e.g. stearone), etc. Other suds inhibitors include N-alkylated amino triazines such as tri- to hexa-alkylmelamines or di- to tetra-alkyldiamine chlortriazines formed as products of cyanuric chloride with two or three moles of a primary or secondary amine containing 1 to 24 carbon atoms, propylene oxide, and monostearyl phosphates such as monostearyl alcohol phosphate ester and monostearyl di-alkali metal (e.g., sodium, potassium, lithium) phosphates and phosphate esters. The hydrocarbons, such as paraffin and haloparaffin, can be utilized in liquid form. The liquid hydrocarbons will be liquid at room temperature and atmospheric pressure, and will have a pour point in the range of about −40° C. and about 5° C., and a minimum boiling point not less than about 110° C. (atmospheric pressure). It is also known to utilize waxy hydrocarbons, preferably having a melting point below about 100° C. The hydrocarbons constitute a preferred category of suds suppressor for detergent compositions. Hydrocarbon suds suppressors are described, for example, in U.S. Pat. No. 4,265,779, issued May 5, 1981 to Gandolfo, et al., incorporated herein by reference. The hydrocarbons, thus, include aliphatic, alicyclic, aromatic, and heterocyclic saturated or unsaturated hydrocarbons having from about 12 to about 70 carbon atoms. The term "paraffin," as used in this suds suppressor discussion, is intended to include mixtures of true paraffins and cyclic hydrocarbons.

Another preferred category of non-surfactant suds comprises silicone suds suppressors. This category includes the use of polyorganosiloxane oils, such as polydimethylsiloxane, dispersions or emulsions of polyorganosiloxane oils or resins, and combinations of polyorganosiloxane with silica particles wherein the polyorganosiloxane is chemisorbed of fused onto the silica. Silicone suds suppressors are well known in the art and are, for example, disclosed in U.S. Pat. No. 4,265,779, issued May 5, 1981 to Gandolfo et al. and European Patent Application No. 89307851.9, published Feb. 7, 1990, by Starch, M. S., both incorporated herein by reference.

Other silicone suds suppressors are disclosed in U.S. Pat. No. 3,455,839 which relates to compositions and processes for defoaming aqueous solutions by incorporating therein small amounts of polydimethylsiloxane fluids.

Mixtures of silicone and silanated silica are described, for instance, in German Patent Application DOS 2,124,526. Silicone defoamers and suds controlling agents in granular detergent compositions are disclosed in U.S. Pat. No. 3,933,672, Bartolotta et al., and in U.S. Pat. No. 4,652,392, Baginski et al., issued Mar. 24, 1987.

An exemplary silicone based suds suppressor for use herein is a suds suppressing amount of a suds controlling agent consisting essentially of:

(i) polydimethylsiloxane fluid having a viscosity of from about 20 cs. to about 1500 cs. at 25° C.;

(ii) from about 5 to about 50 parts per 100 parts by weight of (i) of siloxane resin composed of $(CH_3)_3SiO_{\frac{1}{2}}$ units of $SiO_2$ units in a ratio of from $(CH_3)_3SiO_{\frac{1}{2}}$ units and to $SiO_2$ units of from about 0.6:1 to about 1.2:1; and (iii) from about 1 to about 20 parts per 100 parts by weight of (i) of a solid silica gel;

Suds suppressors, when utilized, are present in a "suds suppressing amount." By "suds suppressing amount" is meant that the formulator of the composition can select an amount of this suds controlling agent that will control the suds to the extent desired. The amount of suds control will vary with the detergent surfactant selected. For example, with high sudsing surfactants, relatively more of the suds controlling agent is used to achieve the desired suds control than with low foaming surfactants.

The compositions hereof will generally comprise from 0% to about 5% of suds suppressor. When utilized as suds suppressors, monocarboxylic fatty acids, and salts thereof, will be present typically in amounts up to about 5%, by weight, of the detergent composition. Preferably, from about 0.5% to about 3% of fatty monocarboxylate suds suppressor is utilized. Silicone suds suppressors are typically utilized in amounts up to about 2.0%, by weight, of the detergent composition, although higher amounts may be used. This upper limit is practical in nature, due primarily to concern with keeping costs minimized and effectiveness of lower amounts for effectively controlling sudsing. Preferably from about 0.01% to about 1% of silicone suds suppressor is used, more preferably from about 0.25% to about 0.5%. As used herein, these weight percentage values include any silica that may be utilized in combination with polyorganosiloxane, as well as any adjunct materials that may be utilized. Monostearyl phosphates are generally utilized in amounts ranging from about 0.1% to about 2% by weight of the composition.

Hydrocarbon suds suppressors are typically utilized in amounts ranging from about 0.01% to about 5.0%, although higher levels can be used.

Enzymes

Detersive enzymes can be included in the detergent formulations for a variety of reasons including removal of protein-based, carbohydrate-based, or triglyceride-based stains, for example, and prevention of refugee dye transfer. The enzymes to be incorporated include proteases, amylases, lipases, cellulases, and peroxidases, as well as mixtures thereof. They may be of any suitable origin, such as vegetable, animal, bacterial, fungal and yeast origin. However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Suitable examples of proteases are the subtilisins which are obtained from particular strains of B.subtilis and B.licheniforms. Another suitable protease is obtained from a strain of Bacillus, having maximum activity throughout the pH range of 8–12, developed and sold by Novo Industries A/S under the registered trade name Esperase ®. The preparation of this enzyme and analogous enzymes is described in British patent specification No. 1,243,784 of Novo. Proteolytic enzymes suitable for removing protein-based stains that are commercially available include those sold under the tradenames ALCALASE TM and SAVINASE TM by Novo Industries A/S (Denmark) and MAXATASE TM by International Bio-Synthetics, Inc. (The Netherlands).

Of interest in the category of proteolytic enzymes, especially for liquid detergent compositions, are enzymes referred to herein as Protease A and Protease B. Protease A and methods for its preparation are described in European Patent Application 130,756, published Jan. 9, 1985, incorporated herein by reference. Protease B is a proteolytic enzyme which differs from Protease A in that it has a leucine substituted for tyrosine in position 217 in its amino acid sequence. Protease B is described in European Patent Application Serial No. 87303761.8, filed Apr. 28, 1987, incorporated herein by reference. Methods for preparation of Protease B are also disclosed in European Patent Application 130,756, Bott et al., published Jan. 9, 1985, incorporated herein by reference.

Amylases include, for example, α-amylases obtained from a special strain of B.licheniforms, described in more detail in British patent specification No. 1,296,839 (Novo), previously incorporated herein by reference. Amylolytic proteins include, for example, RAPIDASE TM, International Bio-Synthetics, Inc. and TERMAMYL TM, Novo Industries.

The cellulases usable in the present invention include both bacterial or fungal cellulase. Preferably, they will have a pH optimum of between 5 and 9.5. Suitable cellulases are disclosed in U.S. Pat. No. 4,435,307, Barbesgoard et al., issued Mar. 6, 1984, incorporated herein by reference, which discloses fungal cellulase produced from Humicola insolens. Suitable cellulases are also disclosed in GB-A-2.075.028; GB-A-2.095.275 and DE-OS-2.247.832.

Examples of such cellulases are cellulases produced by a strain of Humicola insolens (Humicola grisea var. thermoidea), particularly the Humicola strain DSM 1800, and cellulases produced by a fungus of Bacillus N or a cellulase 212-producing fungus belonging to the genus Aeromonas, and cellulase extracted from the hepatopancreas of a marine mollusc (Dolabella Auricula Solander).

Suitable lipase enzymes for detergent usage include those produced by microorganisms of the Pseudomonas group, such as Pseudomonas stutzeri ATCC 19.154, as disclosed in British Patent No. 1,372,034, incorporated herein by reference. Suitable lipases include those which show a positive immunological cross-reaction with the antibody of the lipase, produced by the microorganism *Pseudomonas fluorescens* IAM 1057. This lipase and a method for its purification have been described in Japanese Patent Application No. 53-20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Such lipases of the present invention should show a positive immunological cross reaction with the Amano-P antibody, using the standard and well-known immunodiffusion procedure according to Ouchterlony (Acta. Med. Scan., 133, pages 76–79 (1950)). These lipases, and a method for their immunological cross-reaction with Amano-P, are also described in U.S. Pat. No. 4,707,291, Thom et al., issued Nov. 17, 1987, incorporated herein by reference. Typical examples thereof are the Amano-P lipase, the lipase ex *Pseudomonas fragi* FERM P 1339 (available under the trade name Amano-B), lipase ex *Psuedomonas nitroreducens* var. *lipolyticum* FERM P 1338 (available under the trade name Amano-CES), lipases ex *Chromobacter viscosum*, e.g. *Chromobacter viscosum* var. *lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli*.

Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo- peroxidase. Peroxidase-containing detergent compositions are disclosed, for example, in PCT International Application WO 89/099813, published Oct. 19, 1989, by O Kirk, assigned to Novo Industries A/S, incorporated herein by reference.

A wide range of enzyme materials and means for their incorporation into synthetic detergent granules is also disclosed in U.S. Pat. No. 3,553,139, issued Jan. 5, 1971 to McCarty et al. (incorporated herein by reference). Enzymes are further disclosed in U.S. Pat. No. 4,101,457, Place et al., issued July 18, 1978, and in U.S. Pat. No. 4,507,219, Hughes, issued Mar. 26, 1985, both incorporated herein by reference. Enzyme materials useful for liquid detergent formulations, and their incorporation into such formulations, are disclosed in U.S. Pat. No. 4,261,868, Hora et al., issued Apr. 14, 1981, also incorporated herein by reference.

Enzymes are normally incorporated at levels sufficient to provide up to about 5 mg by weight, more typically about 0.05 mg to about 3 mg, of active enzyme per gram of the composition.

For granular detergents, the enzymes are preferably coated or prilled with additives inert toward the enzymes to minimize dust formation and improve storage stability. Techniques for accomplishing this are well known in the art. In liquid formulations, an enzyme stabilization system is preferably utilized. Enzyme stabilization techniques for aqueous detergent compositions are well known in the art. For example, one technique for enzyme stabilization in aqueous solutions involves the use of free calcium ions from sources such as calcium acetate, calcium formate, and calcium propionate. Calcium ions can be used in combination with short chain carboxylic acid salts, preferably formates. See, for example, U.S. Pat. No. 4,318,818, Letton, et al., issued Mar. 9, 1982, incorporated herein by reference. It has also been proposed to use polyols like glycerol and sorbitol. Alkoxy-alcohols, dialkylglycoethers, mixtures of polyvalent alcohols with polyfunctional aliphatic amines (e.g., alkanolamines such as diethanolamine, triethanolamine, di-isopropanolamine, etc.), and boric acid or alkali metal borate. Enzyme stabilization techniques are additionally disclosed and exemplified in U.S. Pat. No. 4,261,868, issued Apr. 14, 1981 to Horn, et al., U.S. Pat. No. 3,600,319, issued Aug. 17, 1971 to Gedge, et al., both incorporated herein by reference, and European Patent Application Publication No. 0 199 405, Application No. 86200586.5, published Oct. 29, 1986, Venegas. Non-boric acid and borate stabilizers are preferred. Enzyme stabilization systems are also described, for example, in U.S. Pat. Nos. 4,261,868, 3,600,319, and 3,519,570.

Other Ingredients

A wide variety of other ingredients useful in detergent compositions can be included in the compositions hereof, including other active ingredients, carriers, processing aids, dyes or pigments, perfumes, solvents for liquid formulations, hydrotropes (as described below) etc.

Liquid detergent compositions can contain water and other solvents. Low molecular weight primary or secondary alcohols exemplified by methanol, ethanol, propanol, and isopropanol are suitable. Monohydric alcohols are preferred for solubilizing surfactant, but polyols such as those containing from about 2 to about 6 carbon atoms and from about 2 to about 6 hydroxy groups (e.g., propylene glycol, ethylene glycol, glycerine, and 1,2-propanediol) can also be used.

The detergent compositions hereof will preferably be formulated such that during use in aqueous cleaning operations the wash water will have a pH of between about 6.5 and about 11, preferably between about 7.5 and about 10.5. Liquid product formulations preferably have a (10% dilution) pH between about 7.5 and about 10.0, more preferably between about 7.5 and about 9.0. Techniques for controlling pH at recommended usage levels include the use of buffers, alkali, acids, etc., and are well known to those skilled in the art.

PREMIX

The premix of the present invention comprises one or more optical brighteners, one or more polyhydroxy fatty acid amides and a liquid carrier. The optical brighteners, polyhydroxy fatty acid amides and liquid carrier are as already described herein for the detergent compositions of the present invention. Preferably the premix comprises from about 1% to about 20%, more preferably from about 1% to about 10% by weight of the optical brighteners; from about 10% to about 60%, more preferably from about 30% to about 50% by weight of the polyhydroxy fatty acid amides; and from about 20% to about 89%, more preferably from about 40% to about 69% by weight of the liquid carrier.

It is important to note that the premix of the present invention has a gelling temperature in the range of from about 40° C. to about 48° C., depending upon the product purity. However, this gelling temperature can be lowered by the addition of one or more select additional components. Thus, if the premix is to be used when preparing optical brightener-containing liquid detergent compositions, it must either be kept above about 40° C. to about 48° C. or it must contain the select additional component.

Select additional components useful for lowering the gelling temperature of the premix include, but are not limited to, anionic surfactants (as already described herein), solvents, ethanolamine, preferably mono- and triethanolamines, and hydrotropes. Examples of solvents useful for lowering the gelling temperature of the premix include, but are not limited to, $C_1$–$C_6$ alcohols, preferably $C_2$–$C_4$ alcohols, and $C_1$–$C_6$ glycols, preferably $C_2$–$C_4$ glycols. Examples of hydrotropes useful for lowering the gelling temperature of the premix include, but are not necessarily limited to, alcohol (as already described herein), sodium and potassium toluene sulfonate, sodium and potassium xylene sulfonate, sodium and potassium cumene sulfonate, trisodium and tripotassium sulfosuccinate, and related compounds (as disclosed in U.S. Pat. No. 3,915,903, the disclosure of which is incorporated herein by reference). When included in the premix of the present invention, such select additional components will typically be present at a concentration in the range of from about 1% to about 40%, preferably from about 5% to about 30%, more preferably from about 5% to about 20% by weight.

The premix of the present invention may be prepared by methods which will be apparent to those skilled in the art. One such preparation method is as follows: the liquid carrier, preferably water, and the polyhydroxy fatty acid amide are combined in a mixing vessel to form an initial binary composition. The polyhydroxy amide will typically comprise from about 30% to about 70%, preferably from about 45% to about 55% by weight of the initial binary composition. This initial binary composition must be maintained at a temperature above about 50° C. to allow for a free-flowing composition. The initial binary composition is then mixed until the ingredients are sufficiently interspersed, typically for a period of from about 5 to about 60 minutes, more typically for a period of from about 10 to about 20 minutes.

The desired amount of optical brightener is then added to the initial binary composition to form the premix. The brightener is added to the initial binary composition as a powder and may be in the form of a salt or an acid. If added as an acid, a neutralizing agent is then added to the premix, typically in quantities sufficient to effectively neutralize substantially all the added brightener.

Any solvents or hydrotropes desired for viscosity adjustments are next added, optionally followed by any additional components for lowering the gelling temperature of the premix to the desired temperature. Other optional ingredients may also be added at this point.

The premix is then mixed until a uniform or single phase is formed, typically for a period of from about 5 to about 60 minutes, more typically from about 10 to about 30 minutes. The additional, optional ingredients may also be added to the premix after this mixing step, although it is preferred that any ingredients added to lower the gelling temperature be added prior to this final mixing step.

Optional Ingredients

The premix of the present invention may also contain optional ingredients which include, but are not necessarily limited to, buffering agents, solvents and hydrotropes of the type already described herein. The hydrotropes are especially preferred for lowering the gel temperature of the premix and for the viscosity properties they impart to the premix.

Buffering agents which may be included in such premix include, but are not necessarily limited to, glycine, N,N-bis(2-hydroxyethyl)glycine, tris(hydroxymethyl-)aminoethane, triethanolamine, 2-amino-2-ethyl-1,3-propanediol, 2-amino-2-methyl-1,3-propanediol, N-methyl diethanolamine, 1,3-diamino-2-hydroxypropane, and mixtures thereof. When present in the premix of the present invention, such buffering agents typically comprise from about 1% to about 40%, preferably from about 3% to about 20%, more preferably from about 5% to about 20% by weight of the premix.

Process for Preparing Detergent Composition Containing Optical Brighteners

The present invention is also directed toward a process for preparing liquid detergent compositions containing one or more conventional anionic, nonionic or cationic detersive surfactants, optional detersive adjuncts, optical brighteners, and a polyhydroxy fatty acid amide. This process is especially suited for preparing clear, isotropic highly built liquid detergent compositions. By "highly built", it is meant a detergent composition having a high builder content, typically comprising from about 10% to about 50%, preferably from about 15% to about 40%, most preferably from about 15% to about 30% by weight.

In the process of the present invention, the detergent compositions may be prepared in any manner known to one skilled in the art, with the exception of the critical step of adding the brightener as a brightener/polyhydroxy fatty acid amide premix as already described herein.

In a typical detergent composition preparation process, a detersive surfactant, which is typically selected from a linear alkylate sulfonate, a sulfonic acid, ether sulfate, olefin sulfonate, ether sulfonate, or amine oxide, is charged into a mixing vessel. Any necessary solvents are then added to the mixing vessel. Examples of such solvents include, but are not necessarily limited to, propane diol, methyl and ethyl alcohol, monoethanolamine and a hydrotrope of the type already described herein. The optical brightener is next added to the mixing vessel via the premix already described herein. It is not critical that the optical brightener be added at this point in the process, although it is critical that it be added via the premix. The optical brightener may also be added, via the premix, after the builders have been added. There are different advantages associated with each preparation method. For example, adding the brightener premix following the solvent addition allows for longer mixing time, whereas adding the brightener premix following the builder addition allows for greater formulation flexibility.

Following the addition of the optical brightener, any acidic surfactants and builders will typically be added. A neutralizing step will then follow to adjust the pH of the composition to the desired range, which is typically from about 5 to about 11 preferably from about 6 to about 10, most preferably from about 7 to about 10. After these ingredients have been added to the mixing vessel, they are stirred until thoroughly mixed. The detergent mixture is then allowed to cool. The cooling step is typically accompanied by further mixing. At this point pre-neutralized builders and other performance boosters, such as dispersants, soil release polymers, perfumes, and enzymes may be added.

EXPERIMENTAL

This exemplifies a process for making a N-methyl, 1-deoxyglucityl lauramide surfactant for use herein. Although a skilled chemist can vary apparatus configuration, one suitable apparatus for use herein comprises a three-liter four-necked flask fitted with a motor-driven paddle stirrer and a thermometer of length sufficient to contact the reaction medium. The other two necks of the flask are fitted with a nitrogen sweep and a wide-bore side- arm (caution: a wide-bore side-arm is important in case of very rapid methanol evolution) to which is connected an efficient collecting condenser and vacuum outlet. The latter is connected to a nitrogen bleed and vacuum gauge, then to an aspirator and a trap. A 500 watt heating mantle with a variable transformer temperature controller ("Variac") used to heat the reaction is so placed on a lab-jack that it may be readily raised or lowered to further control temperature of the reaction.

N-methylglucamine (195 g., 1.0 mole, Aldrich, M4700-0) and methyl laurate (Procter & Gamble CE 1270, 220.9 g., 1.0 mole) are placed in a flask. The solid/liquid mixture is heated with stirring under a nitrogen sweep to form a melt (approximately 25 minutes). When the melt temperature reaches 145° C., catalyst (anhydrous powdered sodium carbonate, 10.5 g., 0.1 mole, J. T. Baker) is added. The nitrogen sweep is shut off and the aspirator and nitrogen bleed are adjusted to give 5 inches (5/31 atm.) Hg. vacuum. From this point on, the reaction temperature is held at 150° C. by adjusting the Variac and/or by raising or lowering the mantle.

Within 7 minutes, first methanol bubbles are sighted at the meniscus of the reaction mixture. A vigorous reaction soon follows. Methanol is distilled over until its rate subsides. The vacuum is adjusted to give about 10 inches Hg. (10/31 atm.) vacuum. The vacuum is increased approximately as follows (in inches Hg. at minutes): 10 at 3, 20 at 7, 25 at 10. 11 minutes from the onset of methanol evolution, heating and stirring are discontinued co-incident with some foaming. The product is cooled and solidifies.

The following examples are meant to exemplify compositions of the present invention, but are not necessarily meant to limit or otherwise define the scope of the invention, said scope being determined according to claims which follow.

EXAMPLES

The following examples are meant to exemplify compositions of the present invention, including premix compositions, and methods for preparing detergent compositions by use of an optical brightener/polyhydroxy fatty acid amide premix. These examples are not meant to limit or otherwise define the scope of the invention, said scope being determined according to claims which follow.

EXAMPLE I

The following premix is prepared by adding the components to a mixing tank with continuous mixing.

| Component | Wt. % of Composition |
|---|---|
| N-coconut, N-methyl glucamide | 40.0 |
| Monoethanolamine | 15.0 |
| Brightener | 4.5 |
| Water | balance to 100% |

This premix is formed by adding 400 grams of purified N-coconut, N-methyl glucamide to 405 grams of water (heated to 50° C.) in a stainless steel mixing vessel to form an initial binary composition. This initial binary composition is maintained at a temperature of about 50° C. while being stirred for a period of 20 minutes. 150 grams of monoethanolamine is then added to the initial binary composition, followed by the addition of 45 grams of brightener, thereby forming a premix. The temperature of the premix is maintained at 50° C. while being stirred for a period of 20 minutes. This yields 1000 grams of a single phase product.

| Component | Wt. % of Composition |
|---|---|
| N-coconut, N-methyl glucamide | 50.0 |
| Sodium cumene sulfonate | 2.0 |
| Brightener | 5.0 |
| Water | balance to 100% |

This premix is formed in the same manner as the premix of Example I, except the sodium cumene sulfonate is substituted for the monoethanolamine.

EXAMPLE III

A highly built, brightener-containing liquid detergent composition is prepared as follows:

A surfactant paste prepared with ethanol, caustic, propylene glycol and sodium $C_{14-15}$ alkyl ethoxy sulfonate is introduced into a glass or metal beaker with mixing by an IKA or equivalent mixer equipped with an appropriately sized propeller shaft. The following ingredients are then sequentially weighted and added to the beaker under agitation (all ingredients are added at room temperature unless otherwise specified): a 45 wt. % sodium cumene sulfonate solution; propylene glycol; the brightener premix of Example I; additional monoethanolamine; ethanol; potassium hydroxide; sodium hydroxide; $C_{11}$–$C_{13}$ linear alkylbenzene sulfonate; the acid form of methyl ester sulfonate (if needed); fatty acid (warmed to 120° F.); aqueous citric acid; aqueous mixtures of sodium oxydisuccinate and tartrate disuccinate; aqueous calcium formate; aqueous sodium formate; aqueous tallow trimethyl ammonium chloride; aqueous ethoxylated tetraethylenepentaamine; boric acid and remaining water. The pH is adjusted with either citric acid solution or sodium hydroxide solution to the desired target of 9.5±1.0.

The following ingredients are added after pH adjustment: soil release agents; enzyme stock solution; color mix and perfume. Within 5 minutes, depending upon batch size, the mixture becomes a single phase, isoptropic fluid having a viscosity of about 90 cps, measured with a Brookfield RVT viscometer at 70° F. using a #2 spindle @ 50 rpm.

A typical composition prepared in this manner is comprised as follows:

| Component | Wt. % of Composition |
|---|---|
| $C_{14-15}$ ethoxylated sulfate paste* | 12.41 |
| Sodium cumene sulfonate solution (45%) | 11.11 |
| Additional propylene glycol | 3.7 |
| Brightener premix of Example I | 2.45 |
| Monoethanolamine | 1.0 |
| NaOH | 0.65 |
| $C_{11}$–$C_{13}$ linear alkylbenzene sulfonate (95%) | 6.32 |
| $C_{12}$–$C_{14}$ fatty acid (warmed to 120° F.) | 1.0 |
| Tetrasodium oxydisuccinate | 20.0 |
| Soil release agents | 1.0 |
| Enzyme stock solution (40 g/l) | 0.25 |
| Boric acid | 1.0 |
| Water & misc. (perfumes, dyes opacifiers, dispersing agents, etc.) | balance |

*The $C_{14-15}$ ethoxylated sulfate paste is comprised as follows (all percentages are weight percent): 11% ethanol; 7.7% caustic; 17.6% propylene glycol; and 63.7% sodium $C_{14-15}$ alkyl ethoxy sulfate.

EXAMPLE IV

The following liquid detergent compositions are prepared in the same manner as the composition of Example III. All percentages are weight percentages.

| COMPONENTS | A | B | C | D | E | F | G | H |
|---|---|---|---|---|---|---|---|---|
| SURFACTANTS: | | | | | | | | |
| $C_{12-14}$ alkyl N-methyl glucamide | 3.1 | 5.0 | 5.0 | 6.0 | 1.0 | 5.0 | 8.0 | 7.0 |
| $C_{16-18}$ olefin sulfonate | — | — | — | — | 5.0 | — | — | — |
| Dodecyl benzene sulfonate | — | 3.0 | — | — | 5.0 | 15.0 | — | — |
| $C_{14-16}$ alkyl ethoxy (2.25 ave.) sulfate | 6.2 | 5.0 | 5.0 | 8.0 | — | 5.0 | 5.0 | — |
| $C_{14-18}$ paraffin sulfonate | — | — | — | — | — | — | — | 8.0 |
| $C_{12-16}$ polyglycoside (1.5 ave.) | — | — | — | — | — | — | 5.0 | 5.0 |
| $C_{14-16}$ alkyl sulfate | 3.1 | — | 3.0 | 2.0 | — | — | 1.0 | 2.0 |
| $C_{12-18}$ alkyl ethoxy (1–3 ave.) carboxylate | — | — | — | — | 3.0 | — | — | — |
| BUILDERS: | | | | | | | | |
| Sodium oxydisuccinate | — | — | 19.0 | 8.0 | — | — | — | — |
| Sodium diethyl trinitrilo pentaacetate | — | 2.0 | — | — | — | — | — | — |
| Sodium citrate | 7.5 | 11.0 | — | — | — | — | — | 7.0 |
| Sodium tartrate monosuccinate | 7.0 | 4.0 | — | — | — | — | 7.0 | — |
| Sodium tartrate disuccinate | 3.0 | 2.0 | — | — | — | — | — | — |
| Sodium carboxymethyl Tetrasodium oxysuccinate | — | — | — | — | — | 6.0 | — | — |
| Sodium oxydiacetate | — | — | — | — | — | — | 1.0 | — |
| Sodium carboxymethyl tartronate | — | — | — | — | — | — | — | 1.0 |
| Sodium carboxymethyl-aspartate | — | — | — | — | — | 2.0 | — | — |

-continued

| COMPONENTS | A | B | C | D | E | F | G | H |
|---|---|---|---|---|---|---|---|---|
| Sodium N-methyl carboxy-methyl aspartate | — | — | — | — | — | — | 2.0 | — |
| Sodium iminodisuccinate | — | — | — | — | — | — | — | 2.0 |
| Sodium maleate | — | — | — | — | — | 2.0 | — | — |
| Sodium tartrate | — | — | — | — | 3.0 | — | — | — |
| Sodium glutarate | — | — | — | 3.0 | — | — | — | — |
| Sodium glycine | — | 2.0 | — | — | — | — | — | — |
| Sodium sarcosine | — | — | 3.0 | — | — | — | — | — |
| Myristic acid ($C_{14}$ saturated) | — | — | — | — | — | 3.0 | — | — |
| Polyacrylic acid (3,000 M.W.) | — | 1.0 | — | — | — | — | — | — |
| HYDRO-TROPES/ SOLVENTS: | | | | | | | | |
| Monoethanolamine | 1.0 | 3.0 | 3.0 | — | — | 2.0 | 2.0 | 2.0 |
| Sodium cumene sulfonate/ potassium cumene sulfonate | 5.0 | 5.0 | 5.0 | — | 5.0 | — | — | — |
| Sodium xylene sulfonate/ potassium xylene sulfonate | — | — | — | 3.0 | — | 5.0 | — | 5.0 |
| Sodium toluene sulfonate/ potassium toluene sulfonate | — | 1.5 | — | 2.0 | — | — | 5.0 | — |
| Propanediol | 5.5 | 6.0 | 5.0 | 5.0 | 1.0 | 3.0 | 2.5 | 1.0 |
| Ethanol | 0.87 | 0.60 | 0.60 | 1.0 | — | 0.60 | 0.60 | 0.50 |
| Isopropanol | 1.0 | — | — | — | 3.0 | 2.0 | 2.5 | 4.0 |
| ADDITIVES: | | | | | | | | |
| Brightener premix of Example I | 2.4 | — | — | — | 3.0 | 2.0 | 4.0 | 5.0 |
| Brightener premix of Example II | — | 3.0 | 3.0 | 2.5 | 3.0 | — | — | — |
| NaOH | 0.5 | — | 0.5 | — | 0.4 | — | 0.3 | — |
| KOH | — | 0.5 | — | 0.4 | — | 0.2 | — | 0.2 |
| Polyethylene glycol | — | — | — | 2.0 | — | 3.0 | — | — |
| Water & misc. (enzymes, perfumes, dyes, dispersants and other minor additives) | balance to 100% | | | | | | | |

EXAMPLE V

The following liquid detergent compositions are prepared in the same manner as the composition of Example III. All percentages are weight percentages.

| COMPONENTS | A | B | C | D | E | F | G |
|---|---|---|---|---|---|---|---|
| SURFACTANTS: | | | | | | | |
| $C_{12-14}$ alkyl N-methyl glucamide | 12.0 | 20.0 | 5.0 | 10.0 | 7.0 | 5.0 | 10.0 |
| $C_{16-18}$ olefin sulfonate | — | — | — | — | 5.0 | — | — |
| Dodecyl benzene sulfonate | — | — | — | — | 5.0 | — | — |
| $C_{14-16}$ alkyl ethoxy (1.0 ave.) sulfate | — | 6.0 | — | — | — | — | — |
| $C_{14-16}$ alkyl ethoxy (2.25 ave.) sulfate | — | — | — | — | — | 12.0 | — |
| $C_{14-18}$ methylester sulfonate | — | — | 10.0 | — | — | — | — |
| $C_{12-16}$ polyglycolside (1.3 ave.) | — | — | — | 5.0 | — | — | 5.0 |
| $C_{14-16}$ alkyl sulfate | 2.0 | — | — | — | — | — | — |
| $C_{12-16}$ glycerol sulfonate | — | — | — | 4.0 | — | — | — |
| $C_{12-18}$ sarcosinates | 5.0 | — | — | — | — | — | 5.0 |
| Sucrose monoalkylate | — | — | 4.0 | — | — | — | — |

-continued

| COMPONENTS | A | B | C | D | E | F | G |
|---|---|---|---|---|---|---|---|
| $C_{12-18}$ taurinate | — | — | — | 2.0 | — | — | — |
| BUILDERS: | | | | | | | |
| Sodium ditartronate | 10.0 | — | — | — | — | — | — |
| TKPP | — | 13.0 | — | — | — | — | — |
| Sodium ethylene diamine disuccinate | — | — | 12.0 | — | — | — | — |
| Sodium nitrilotriacetate | — | — | — | 12.0 | — | — | — |
| Sodium pyridine-2.6-di-carboxylate | — | — | — | — | 5.0 | — | — |
| Sodium iminodisuccinate | — | — | — | — | — | 5.0 | — |
| Sodium N-2-hydroxyethyl iminodiacetate | — | — | — | — | — | — | 5.0 |
| Sodium N-(2-(2-hydroxy-ethoxy)ethyl) iminodiacetate | — | — | — | — | — | 5.0 | — |
| Sodium N-(2.3-dihydroxy-propyl) iminodiacetate | — | — | — | — | 5.0 | — | — |
| Sodium malate | 2.0 | — | — | — | — | — | — |
| Sodium fumarate | — | — | 2.0 | — | — | — | — |
| Sodium succinate | — | — | — | 2.0 | — | — | — |
| Sodium hydroxyacetate | — | — | — | — | — | 4.0 | — |
| Sodium adipate | — | — | — | — | — | — | 2.0 |
| Oleic acid | — | — | — | 2.0 | — | — | — |
| Dodecenyl succinate | — | — | — | — | 2.0 | — | 2.0 |
| Tetradocenyl succinate | — | — | — | — | — | 2.0 | 2.0 |
| HYDROTROPES/ SOLVENTS: | | | | | | | |
| Monoethanolamine | 2.0 | 3.0 | 4.0 | 2.0 | 1.0 | 4.0 | 3.0 |
| Sodium cumene sulfonate/ potassium cumene sulfonate | 1.0 | — | — | 5.0 | 5.0 | — | — |
| Sodium xylene sulfonate/ potassium xylene sulfonate | 3.0 | 3.0 | 5.0 | — | — | 4.0 | — |
| Sodium toluene sulfonate/ potassium toluene sulfonate | — | 4.0 | — | 2.0 | — | — | 5.0 |
| Propanediol | 5.0 | 4.0 | 4.0 | 3.0 | — | 4.0 | 4.0 |
| Ethanol | — | 0.5 | 1.0 | 0.5 | — | 2.0 | 1.0 |
| Isopropanol | — | 2.0 | — | 3.0 | 6.0 | 4.0 | — |
| Sodium sulfosuccinate | 2.0 | — | — | — | — | — | 3.0 |
| ADDITIVES: | | | | | | | |
| Brightener premix of Example I | 2.0 | 1.5 | 3.0 | 3.0 | 2.5 | — | — |
| Brightener premix of Example II | — | — | — | — | — | 3.0 | 3.0 |
| NaOH | — | — | — | — | — | — | 1.0 |
| KOH | 1.5 | 1.5 | 1.8 | 1.8 | 1.0 | 1.0 | — |
| Polyethylene glycol | — | — | — | — | — | — | — |
| Water & misc. (enzymes, perfumes, dyes, dispersants and other minor additives) | balance to 100% | | | | | | |

EXAMPLE VI

An alternate method for preparing the polyhydroxy fatty acid amides used herein is as follows. A reaction mixture consisting of 84.87g. fatty acid methyl ester (source: Procter & Gamble methyl ester CE1270), 75g. N-methyl-D-glucamine (source: Aldrich Chemical Company M4700-0), 1.04g. sodium methoxide (source: Aldrich Chemical Company 16,499-2), and 68.51g.

methyl alcohol is used. The reaction vessel comprises a standard reflux set-up fitted with a drying tube, condenser and stir bar. In this procedure, the N-methyl glucamine is combined with methanol with stirring under argon and heating is begun with good mixing (stir bar; reflux). After 15-20 minutes, when the solution has reached the desired temperature, the ester and sodium methoxide catalyst are added. Samples are taken periodically to monitor the course of the reaction, but it is noted that the solution is completely clear by 63.5 minutes. It is judged that the reaction is, in fact, nearly complete at that point. The reaction mixture is maintained at reflux for 4 hours. After removal of the methanol, the recovered crude product weighs 156.16 grams. After vacuum drying and purification, an overall yield of 106.92 grams purified product is recovered. However, percentage yields are not calculated on this basis, inasmuch as regular sampling throughout the course of the reaction makes an overall percentage yield value meaningless. The reaction can be carried out at 80% and 90% reactant concentrations for periods up to 6 hours to yield products with extremely small by-product formation.

The following is not intended to limit the invention herein, but is simply to further illustrate additional aspects of the technology which may be considered by the formulator in the manufacture of a wide variety of detergent compositions using the polyhydroxy fatty acid amides.

It will be readily appreciated that the polyhydroxy fatty acid amides are, by virtue of their amide bond, subject to some instability under highly basic or highly acidic conditions. While some decomposition can be tolerated, it is preferred that these materials not be subjected to pH's above about 11, preferably 10, nor below about 3 for unduly extended periods. Final product pH (liquids) is typically 7.0-9.0.

During the manufacture of the polyhydroxy fatty acid amides it will typically be necessary to at least partially neutralize the base catalyst used to form the amide bond. While any acid can be used for this purpose, the detergent formulator will recognize that it is a simple and convenient matter to use an acid which provides an anion that is otherwise useful and desirable in the finished detergent composition. For example, citric acid can be used for purposes of neutralization and the resulting citrate ion (ca. 1%) be allowed to remain with a ca. 40% polyhydroxy fatty acid amide slurry and be pumped into the later manufacturing stages of the overall detergent-manufacturing process. The acid forms of materials such as oxydisuccinate, nitrilotriacetate, ethylenediaminetetraacetate, tartrate/succinate, and the like, can be used similarly.

The polyhydroxy fatty acid amides derived from coconut alkyl fatty acids (predominantly $C_{12}$-$C_{14}$) are more soluble than their tallow alkyl (predominantly $C_{16}$-$C_{18}$) counterparts. Accordingly, the $C_{12}$-$C_{14}$ materials are somewhat easier to formulate in liquid compositions, and are more soluble in cool-water laundering baths. However, the $C_{16}$-$C_{18}$ materials are also quite useful, especially under circumstances where warm-to-hot wash water is used. Indeed, the $C_{16}$-$C_{18}$ materials may be better detersive surfactants than their $C_{12}$-$C_{14}$ counterparts. Accordingly, the formulator may wish to balance ease-of-manufacture vs. performance when selecting a particular polyhydroxy fatty acid amide for use in a given formulation.

It will also be appreciated that the solubility of the polyhydroxy fatty acid amides can be increased by having points of unsaturation and/or chain branching in the fatty acid moiety. Thus, materials such as the polyhydroxy fatty acid amides derived from oleic acid and iso-stearic acid are more soluble than their n-alkyl counterparts.

Likewise, the solubility of polyhydroxy fatty acid amides prepared from disaccharides, trisaccharides, etc., will ordinarily be greater than the solubility of their monosaccharide-derived counterpart materials. This higher solubility can be of particular assistance when formulating liquid compositions. Moreover, the polyhydroxy fatty acid amides wherein the polyhydroxy group is derived from maltose appear to function especially well as detergents when used in combination with conventional alkylbenzene sulfonate ("LAS") surfactants. While not intending to be limited by theory, it appears that the combination of LAS with the polyhydroxy fatty acid amides derived from the higher saccharides such as maltose causes a substantial and unexpected lowering of interfacial tension in aqueous media, thereby enhancing net detergency performance. (The manufacture of a polyhydroxy fatty acid amide derived from maltose is described hereinafter.)

The polyhydroxy fatty acid amides can be manufactured not only from the purified sugars, but also from hydrolyzed starches, e.g., corn starch, potato starch, or any other convenient plant-derived starch which contains the mono-, di-, etc. saccharide desired by the formulator. This is of particular importance from the economic standpoint. Thus, "high glucose" corn syrup, "high maltose" corn syrup, etc. can conveniently and economically be used. De-lignified, hydrolyzed cellulose pulp can also provide a raw material source for the polyhydroxy fatty acid amides.

As noted above, polyhydroxy fatty acid amides derived from the higher saccharides, such as maltose, lactose, etc., are more soluble than their glucose counterparts. Moreover, it appears that the more soluble polyhydroxy fatty acid amides can help solubilize their less soluble counterparts, to varying degrees. Accordingly, the formulator may elect to use a raw material comprising a high glucose corn syrup, for example, but to select a syrup which contains a modicum of maltose (e.g., 1% or more). The resulting mixture of polyhydroxy fatty acids will, in general, exhibit more preferred solubility properties over a broader range of temperatures and concentrations than would a "pure" glucose-derived polyhydroxy fatty acid amide. Thus, in addition to any economic advantages for using sugar mixtures rather than pure sugar reactants, the polyhydroxy fatty acid amides prepared from mixed sugars can offer very substantial advantages with respect to performance and/or ease-of-formulation. In some instances, however, some loss of grease removal performance (dishwashing) may be noted at fatty acid maltamide levels above about 25% and some loss in sudsing above about 33% (said percentages being the percentage of maltamide-derived polyhydroxy fatty acid amide vs. glucose-derived polyhydroxy fatty acid amide in the mixture). This can vary somewhat, depending on the chain length of the fatty acid moiety. Typically, then, the formulator electing to use such mixtures may find it advantageous to select polyhydroxy fatty acid amide mixtures which contain ratios of monosaccharides (e.g., glucose) to di- and higher saccharides (e.g., maltose) from about 4:1 to about 99:1.

The manufacture of preferred uncyclized polyhydroxy fatty acid amides from fatty esters and N-alkyl polyols can be carried out in alcohol solvents at temperatures from about 30° C.-90° C., preferably about 50° C. to 80° C. It has now been determined that it may be convenient for the formulator of, for example, liquid detergents to conduct such processes in 1,2-propylene glycol solvent, since the glycol solvent need not be completely removed from the reaction product prior to use in the finished detergent formulation. Likewise, the formulator of, for example, solid, typically granular, detergent compositions may find it convenient to run the process at 30° C.-90° C. in solvents which comprise ethoxylated alcohols, such as the ethoxylated (EO 3-8) $C_{12}$-$C_{14}$ alcohols, such as those available as NEODOL 23 E06.5 (Shell). When such ethoxylates are used, it is preferred that they not contain substantial amounts of unethoxylated alcohol and, most preferably, not contain substantial amounts of mono-ethoxylated alcohol. ("T" designation.)

While methods for making polyhydroxy fatty acid amides per se form no part of the invention herein, the formulator can also note other syntheses of polyhydroxy fatty acid amides as described hereinafter.

Typically, the industrial scale reaction sequence for preparing the preferred acyclic polyhydroxy fatty acid amides will comprise: Step 1—preparing the N-alkyl polyhydroxy amine derivative from the desired sugar or sugar mixture by formation of an adduct of the N-alkyl amine and the sugar, followed by reaction with hydrogen in the presence of a catalyst; followed by Step 2—reacting the aforesaid polyhydroxy amine with, preferably, a fatty ester to form an amide bond. While a variety of N-alkyl polyhydroxy amines useful in Step 2 of the reaction sequence can be prepared by various art-disclosed processes, the following process is convenient and makes use of economical sugar syrup as the raw material. It is to be understood that, for best results when using such syrup raw materials, the manufacturer should select syrups that are quite light in color or, preferably, nearly colorless ("water-white").

Preparation of N-Alkyl Polyhydroxy Amine from Plant-Derived Sugar Syrup

I. Adduct Formation—The following is a standard process in which about 420 g of about 55% glucose solution (corn syrup—about 231 g glucose - about 1.28 moles) having a Gardner Color of less than 1 is reacted with about 119 g of about 50% aqueous methylamine (59.5 g of methylamine—1.92 moles) solution. The methylamine (MMA) solution is purged and shielded with $N_2$ and cooled to about 10° C., or less. The corn syrup is purged and shielded with $N_2$ at a temperature of about 10°-20° C. The corn syrup is added slowly to the MMA solution at the indicated reaction temperature as shown. The Gardner Color is measured at the indicated approximate times in minutes.

TABLE I

| Time in Minutes: | 10 | 30 | 60 | 120 | 180 | 240 |
|---|---|---|---|---|---|---|
| Reaction Temp. °C. | Gardner Color (Approximate) | | | | | |
| 0 | 1 | 1 | 1 | 1 | 1 | 1 |
| 20 | 1 | 1 | 1 | 1 | 1 | 1 |
| 30 | 1 | 1 | 2 | 2 | 4 | 5 |
| 50 | 4 | 6 | 10 | — | — | — |

As can be seen from the above data, the Gardner Color for the adduct is much worse as the temperature is raised above about 30° C. and at about 50° C., the time that the adduct has a Gardner Color below 7 is only about 30 minutes. For longer reaction, and/or holding times, the temperature should be less than about 20° C. The Gardner Color should be less than about 7, and preferably less than about 4 for good color glucamine.

When one uses lower temperatures for forming the adduct, the time to reach substantial equilibrium concentration of the adduct is shortened by the use of higher ratios of amine to sugar. With the 1.5:1 mole ratio of amine to sugar noted, equilibrium is reached in about two hours at a reaction temperature of about 30° C. At a 1.2:1 mole ratio, under the same conditions, the time is at least about three hours. For good color, the combination of amine:sugar ratio; reaction temperature; and reaction time is selected to achieve substantially equilibrium conversion, e.g., more than about 90%, preferably more than about 95%, even more preferably more than about 99%, based upon the sugar, and a color that is less than about 7, preferably less than about 4, more preferably less than about 1, for the adduct.

Using the above process at a reaction temperature of less than about 20° C. and corn syrups with different Gardner Colors as indicated, the MMA adduct color (after substantial equilibrium is reached in at least about two hours) is as indicated.

TABLE 2

| | Gardner Color (Approximate) | | | | | | |
|---|---|---|---|---|---|---|---|
| Corn syrup | 1 | 1 | 1 | 1+ | 0 | 0 | 0+ |
| Adduct | 3 | 4/5 | [illegible] | [illegible] | 1 | 2 | 1 |

As can be seen from the above, the starting sugar material must be very near colorless in order to consistently have adduct that is acceptable. When the sugar has a Gardner Color of about 1, the adduct is sometimes acceptable and sometimes not acceptable. When the Gardner Color is above 1 the resulting adduct is unacceptable. The better the initial color of the sugar, the better is the color of the adduct.

II. Hydrogen Reaction—Adduct from the above having a Gardner Color of 1 or less is hydrogenated according to the following procedure.

About 539 g of adduct in water and about 23.1 g of United Catalyst G49B Ni catalyst are added to a one liter autoclave and purged two times with 200 psig $H_2$ at about 20° C. The $H_2$ pressure is raised to about 1400 psi and the temperature is raised to about 50° C. The pressure is then raised to about 1600 psig and the temperature is held at about 50°-55° C. for about three hours. The product is about 95% hydrogenated at this point. The temperature is then raised to about 85° C. for about 30 minutes and the reaction mixture is decanted and the catalyst is filtered out. The product, after removal of water and MMA by evaporation, is about 95% N-methyl glucamine, a white powder.

The above procedure is repeated with about 23.1 g of Raney Ni catalyst with the following changes. The catalyst is washed three times and the reactor, with the catalyst in the reactor, is purged twice with 200 psig $H_2$ and the reactor is pressurized with $H_2$ at 1600 psig for two hours, the pressure is released at one hour and the reactor is repressurized to 1600 psig. The adduct is then pumped into the reactor which is at 200 psig and 20° C., and the reactor is purged with 200 psig $H_2$, etc., as above.

The resulting product in each case is greater than about 95% N-methyl glucamine; has less than about 10 ppm Ni based upon the glucamine; and has a solution color of less than about Gardner 2.

The crude N-methyl glucamine is color stable to about 140° C. for a short exposure time.

It is important to have good adduct that has low sugar content (less than about 5%, preferably less than about 1%) and a good color (less than about 7, preferably less than about 4 Gardner, more preferably less than about 1).

In another reaction, adduct is prepared starting with about 159 g of about 50% methylamine in water, which is purged and shielded with $N_2$ at about 10°-20° C. About 330 g of about 70% corn syrup (near water-white) is degassed with $N_2$ at about 50° and is added slowly to the methylamine solution at a temperature of less than about 20° C. The solution is mixed for about 30 minutes to give about 95% adduct that is a very light yellow solution.

About 190 g of adduct in water and about 9 g of United Catalyst G49B Ni catalyst are added to a 200 ml autoclave and purged three times with $H_2$ at about 20° C. The $H_2$ pressure is raised to about 200 psi and the temperature is raised to about 50° C. The pressure is raised to 250 psi and the temperature is held at about 50°-55° C. for about three hours. The product, which is about 95% hydrogenated at this point, is then raised to a temperature of about 85° C. for about 30 minutes and the product, after removal of water and evaporation, is about 95% N-methyl glucamine, a white powder.

It is also important to minimize contact between adduct and catalyst when the $H_2$ pressure is less than about 1000 psig to minimize Ni content in the glucamine. The nickel content in the N-methyl glucamine in this reaction is about 100 ppm as compared to the less than 10 ppm in the previous reaction.

The following reactions with $H_2$ are run for direct comparison of reaction temperature effects.

A 200 ml autoclave reactor is used following typical procedures similar to those set forth above to make adduct and to run the hydrogen reaction at various temperatures.

Adduct for use in making glucamine is prepared by combining about 420 g of about 55% glucose (corn syrup) solution (231 g glucose; 1.28 moles) (the solution is made using 99DE corn syrup from CarGill, the solution having a color less than Gardner 1) and about 119 g of 50% methylamine (59.5 g MMA; 1.92 moles) (from Air Products).

The reaction procedure is as follows:

1. Add about 119 g of the 50% methylamine solution to a $N_2$ purged reactor, shield with $N_2$ and cool down to less than about 10° C.
2. Degas and/or purge the 55% corn syrup solution at 10°-20° C. with $N_2$ to remove oxygen in the solution.
3. Slowly add the corn syrup solution to the methylamine solution and keep the temperature less than about 20° C.
4. Once all corn syrup solution is added in, agitate for about 1-2 hours.

The adduct is used for the hydrogen reaction right after making, or is stored at low temperature to prevent further degradation.

The glucamine adduct hydrogen reactions are as follows:

1. Add about 134 g adduct (color less than about Gardner 1) and about 5.8 g G49B Ni to a 200 ml autoclave.
2 Purge the reaction mix with about 200 psi $H_2$ twice at about 20°-30° C.
3. Pressure with $H_2$ to about 400 psi and raise the temperature to about 50° C.
4. Raise pressure to about 500 psi, react for about 3 hours. Keep temperature at about 50°-55° C. Take Sample 1.
5. Raise temperature to about 85° C. for about 30 minutes.
6. Decant and filter out the Ni catalyst. Take Sample 2.

Conditions for constant temperature reactions:

1. Add about 134 g adduct and about 5.8 g G49B Ni to a 200 ml autoclave.
2. Purge with about 200 psi $H_2$ twice at low temperature.
3. Pressure with $H_2$ to about 400 psi and raise temperature to about 50° C.
4. Raise pressure to about 500 psi, react for about 3.5 hours. Keep temperature at indicated temperature.
5. Decant and filter out the Ni catalyst. Sample 3 is for about 50°-55° C.; Sample 4 is for about 75° C.; and Sample 5 is for about 85° C. (The reaction time for about 85° C. is about 45 minutes.) All runs give similar purity of N-methyl glucamine (about 94%); the Gardner Colors of the runs are similar right after reaction, but only the two-stage heat treatment gives good color stability; and the 85° C. run gives marginal color immediately after reaction.

EXAMPLE VII

The preparation of the tallow (hardened) fatty acid amide of N-methyl maltamine for use in detergent compositions according to this invention is as follows.

Step 1—Reactants: Maltose monohydrate (Aldrich, lot 01318KW); methylamine (40 wt% in water) (Aldrich, lot 03325TM); Raney nickel, 50% slurry (UAD 52-73D, Aldrich, lot 12921LW).

The reactants are added to glass liner (250 g maltose, 428 g methylamine solution, 100 g catalyst slurry—50 g Raney Ni) and placed in 3 L rocking autoclave, which is purged with nitrogen (3×500 psig) and hydrogen (2×500 psig) and rocked under $H_2$ at room temperature over a weekend at temperatures ranging from 28° C. to 50° C. The crude reaction mixture is vacuum filtered 2× through a glass microfiber filter with a silica gel plug. The filtrate is concentrated to a viscous material. The final traces of water are azetroped off by dissolving the material in methanol and then removing the methanol/water on a rotary evaporator. Final drying is done under high vacuum. The crude product is dissolved in refluxing methanol, filtered, cooled to recrystallize, filtered and the filter cake is dried under vacuum at 35° C. This is cut #1. The filtrate is concentrated until a precipitate begins to form and is stored in a refrigerator overnight. The solid is filtered and dried under vacuum. This is cut #2. The filtrate is again concentrated to half its volume and a recrystallization is performed. Very little precipitate forms. A small quantity of ethanol is added and the solution is left in the freezer over a weekend. The solid material is filtered and dried under vacuum. The combined solids comprise N-methyl maltamine which is used in Step 2 of the overall synthesis.

Step 2—Reactants: N-methyl maltamine (from Step 1); hardened tallow methyl esters; sodium methoxide (25% in methanol); absolute methanol (solvent); mole ratio 1:1 amine:ester; initial catalyst level 10 mole % (w/r maltamine), raised to 20 mole %; solvent level 50% (wt.).

In a sealed bottle, 20.36 g of the tallow methyl ester is heated to its melting point (water bath) and loaded into a 250 ml 3-neck round-bottom flask with mechanical stirring. The flask is heated to ca. 70° C. to prevent the ester from solidifying. Separately, 25.0 g of N-methyl maltamine is combined with 45.36 g of methanol, and the resulting slurry is added to the tallow ester with good mixing. 1.51 g of 25% sodium methoxide in methanol is added. After four hours the reaction mixture has not clarified, so an additional 10 mole % of catalyst (to a total of 20 mole %) is added and the reaction is allowed to continue overnight (ca. 68° C.) after which time the mixture is clear. The reaction flask is then modified for distillation. The temperature is increased to 110° C. Distillation at atmospheric pressure is continued for 60 minutes. High vacuum distillation is then begun and continued for 14 minutes, at which time the product is very thick. The product is allowed to remain in the reaction flask at 110° C. (external temperature) for 60 minutes. The product is scraped from the flask and triturated in ethyl ether over a weekend. Ether is removed on a rotary evaporator and the product is stored in an oven overnight, and ground to a powder. Any remaining N-methyl maltamine is removed from the product using silica gel. A silica gel slurry in 100% methanol is loaded into a funnel and washed several times with 100% methanol. A concentrated sample of the product (20 g in 100 ml of 100% methanol) is loaded onto the silica gel and eluted several times using vacuum and several methanol washes. The collected eluant is evaporated to dryness (rotary evaporator). Any remaining tallow ester is removed by trituration in ethyl acetate overnight, followed by filtration. The filter cake is vacuum dried overnight. The product is the tallowalkyl N-methyl maltamide.

In an alternate mode, Step of the foregoing reaction sequence can be conducted using commercial corn syrup comprising glucose or mixtures of glucose and, typically, 5%, or higher, maltose. The resulting polyhydroxy fatty acid amides and mixtures can be used in any of the detergent compositions herein.

In still another mode, Step 2 of the foregoing reaction sequence can be carried out in 1,2-propylene glycol or NEODOL. At the discretion of the formulator, the propylene glycol or NEODOL need not be removed from the reaction product prior to its use to formulate detergent compositions. Again, according to the desires of the formulator, the methoxide catalyst can be neutralized by citric acid to provide sodium citrate, which can remain in the polyhydroxy fatty acid amide.

Depending on the desires of the formulator, the compositions herein can contain more or less of various suds control agents. Typically, for dishwashing high sudsing is desirable so no suds control agent will be used. For fabric laundering in top-loading washing machines some control of suds may be desirable, and for front-loaders some considerable degree of suds control may be preferred. A wide variety of suds control agents are known in the art and can be routinely selected for use herein. Indeed, the selection of suds control agent, or mixtures of suds control agents, for any specific detergent composition will depend not only on the presence and amount of polyhydroxy fatty acid amide used therein, but also on the other surfactants present in the formulation. However, it appears that, for use with polyhydroxy fatty acid amides, silicone-based suds control agents of various types are more efficient (i.e., lower levels can be used) than various other types of suds control agents. The silicone suds control agents available as X2-3419 and Q2-3302 (Dow Corning) are particularly useful herein.

The formulator of fabric laundering compositions which can advantageously contain soil release agent has a wide variety of known materials to choose from (see, for example, U.S. Pat. Nos. 3,962,152; 4,116,885; 4,238,531; 4,702,857; 4,721,580 and 4,877,896). Additional soil release materials useful herein include the nonionic oligomeric esterification product of a reaction mixture comprising a source of $C_1$–$C_4$ alkoxy-terminated polyethoxy units (e.g., $CH_3[OCH_2CH_2]_{16}OH$), a source of terephthaloyl units (e.g., dimethyl terephthalate); a source of poly(oxyethylene)oxy units (e.g., polyethylene glycol 1500); a source of oxyiso-propyleneoxy units (e.g., 1,2-propylene glycol); and a source of oxyethyleneoxy units (e.g., ethylene glycol) especially wherein the mole ratio of oxyethyleneoxy units:oxyisopropyleneoxy units is at least about 0.5:1. Such nonionic soil release agents are of the general formula

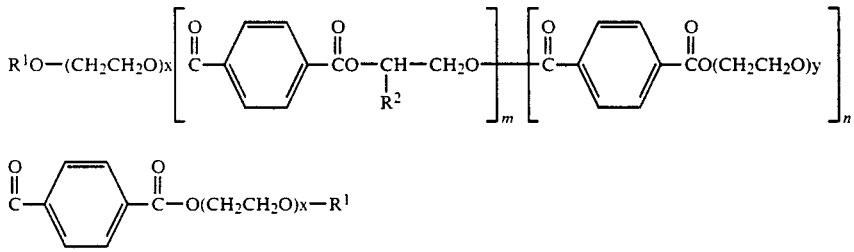

wherein $R^1$ is lower (e.g., $C_1$–$C_4$) alkyl, especially methyl; x and y are each integers from about 6 to about 100; m is an integer of from about 0.75 to about 30; n is an integer from about 0.25 to about 20; and $R^2$ is a mixture of both H and $CH_3$ to provide a mole ratio of oxyethyleneoxy:oxyisopropyleneoxy of at least about 0.5:1.

Another preferred type of soil release agent useful herein is of the general anionic type described in U.S. Pat. No. 4,877,896, but with the condition that such agents be substantially free of monomers of the HOROH type wherein R is propylene or higher alkyl. Thus, the soil release agents of U.S. Pat. No. 4,877,896 can comprise, for example, the reaction product of dimethyl terephthalate, ethylene glycol, 1,2-propylene glycol and 3-sodiosulfobenzoic acid, whereas these additional soil release agents can comprise, for example, the reaction product of dimethyl terephthalate, ethylene glycol, 5-sodiosulfoisophthalate and 3-sodiosulfobenzoic acid. Such agents are preferred for use in granular laundry detergents.

The following relates to the preparation of a preferred liquid heavy duty laundry detergent according to this invention. It will be appreciated that the stability of enzymes in such compositions is considerably less than in granular detergents. However, by using typical enzyme stabilizers such as formate and boric acid, lipase and cellulase enzymes can be protected from degradation by protease enzymes. However, lipase stability is still relatively poor in the presence of alkylbenzene sulfonate ("LAS") surfactants. Apparently, LAS partially denatures lipase, and, further, it seems that denatured lipase is more vulnerable to attack by protease.

In view of the foregoing considerations, which, as noted, can be particularly troublesome in liquid compositions, it is a challenge to provide liquid detergent compositions containing lipase, protease and cellulase enzymes, together. It is particularly challenging to provide such tertiary enzyme systems in stable liquid detergents together with an effective blend of detersive surfactants. Additionally, it is difficult to incorporate peroxidase and/or amylase enzymes stably in such compositions.

It has now been determined that various mixtures of lipases, proteases, cellulases, amylases and peroxidases are adequately stable in the presence of certain non-alkylbenzene sulfonate surfactant systems, such that effective, heavy-duty solid and even liquid detergents can be formulated. Indeed, the formulation of stable, liquid, enzyme-containing detergent compositions constitutes a highly advantageous and preferred embodiment afforded by the technology of the present invention.

In particular, prior art liquid detergent compositions typically contain LAS or mixtures of LAS with surfactants of the $RO(A)_mSO_3M$ type ("AES") noted hereinabove, i.e., LAS/AES mixtures. By contrast, the liquid detergents herein preferably comprise binary mixtures of the AES and polyhydroxy fatty acid amides of the type disclosed herein. While minimal amounts of LAS can be present, it will be appreciated that the stability of the enzymes will be lessened thereby. Accordingly., it is preferred that the liquid compositions be substantially free (i.e., contain less than about 10%, preferably less than about 5%, more preferably less than about 1%, most preferably 0%) of LAS.

The present invention provides a liquid detergent composition comprising:

(a) from about 1% to about 50%, preferably from about 4% to about 40%, of anionic surfactant;

(b) from about 0.0001% to about 2% of active detersive enzyme;

(c) an enzyme performance-enhancing amount (preferably from about 0.5% to about 12%) of a polyhydroxy fatty acid amide material of the formula

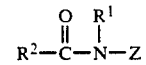

wherein $R^1$ is $H_1$, $C_1$–$C_4$ hydrocarbyl, 2-hydroxy ethyl, 2-hydroxy propyl, or a mixture thereof, $R_2$ is $C_5$–$C_{31}$ hydrocarbyl, and Z is a polyhydroxylhydrocarbyl having a linear hydrocarbyl chain with at least 3 hydroxyls directly connected to said chain, or an alkoxylated derivative thereof;

and wherein the composition is substantially free of alkylbenzene sulfonate.

The water-soluble anionic surfactant herein preferably comprises ("AES"):

$$RO(A)_m\,SO_3\,M$$

wherein R is an unsubstituted $C_{10}$–$C_{24}$ alkyl or hydroxyalkyl ($C_{10}$–$C_{24}$) group, A is an ethoxy or propoxy unit, m is an integer greater than 0 and M is hydrogen or a cation. Preferably, R is an unsubstituted $C_{12}$–$C_{18}$ a alkyl group, A is an ethoxy unit, m is from about 0.5 to about 6, and M is a cation. The cation is preferably a metal cation (e.g., sodium-preferred, potassium, lithium, calcium, magnesium, etc.) or an ammonium or substituted ammonium cation.

It is preferred that the ratio of the above surfactant ("AES") to the polyhydroxy fatty acid amide herein be from about 1:2 to about 8:1, preferably about 1:1 to about 5:1, most preferably about 1:1 to about 4:1.

The liquid compositions herein may alternatively comprise polyhydroxy fatty acid amide, AES, and from about 0.5% to about 5% of the condensation product of $C_8$–$C_{22}$ (preferably $C_{10}$–$C_{20}$) linear alcohol with between about 1 and about 25, preferably between about 2 and about 18, moles of ethylene oxide per mole of alcohol.

As described above, the liquid compositions herein preferably have a pH in a 10% solution in water at 20° C. of from about 6.5 to about 11.0, preferably from about 7.0 to about 8.5.

The instant compositions preferably further comprise from about 0.1% to about 50% of detergency builder. These compositions preferably comprise from about 0.1% to about 20% of citric acid, or water-soluble salt thereof, and from about 0.1% to about 20% of a water-soluble succinate tartrate, especially the sodium salt thereof, and mixtures thereof, or from about 0.1% to about 20% by weight of oxydisuccinate or mixtures thereof with the aforesaid builders. 0.1%-50% alkenyl succinate can also be used.

The preferred liquid compositions herein comprise from about 0.0001% to about 2%, preferably about 0.0001% to about 1%, most preferably about 0.001% to about 0.5%, on an active basis, of detersive enzyme. These enzymes are preferably selected from the group consisting of protease (preferred), lipase (preferred), amylase, cellulase, peroxidase, and mixtures thereof. Preferred are compositions with two or more classes of enzymes, most preferably where one is a protease.

While various descriptions of detergent proteases, cellulases, etc., are available in the literature, detergent lipases may be somewhat less familiar. Accordingly, to assist the formulator, lipases of interest include Amano AKG and Bacillis Sp lipase (e.g., Solvay enzymes). Also, see the lipases described in EP A 0 399 681, published Nov. 28, 1990, EP A 0 218 272, published Apr. 15, 1987 and PCT/DK 88/00177, published May 18, 1989, all incorporated herein by reference.

Suitable fungal lipases include those producible by *Humicola lanuginosa* and *Thermomyces lanuginosus.* Most preferred is the lipase obtained by cloning the gene from *Humicola lanuginosa* and expressed the gene in *Aspergillus oryzae,* as described in European Patent Application 0 258 068, incorporated herein by reference, commercially available under the trade name LIPOLASE.

From about 2 to about 20,000, preferably about 10 to about 6,000, lipase units of lipase per gram (LU/g) of product can be used in these compositions. A lipase unit is that amount of lipase which produces 1 μmol of titratable butyric acid per minute in a pH stat, where pH is 7.0, temperature is 30° C., and substrate is an emulsion tributyrin and gum arabic, in the presence of $Ca^{++}$ and NaCl in phosphate buffer.

The following Example illustrates a preferred heavy duty liquid detergent composition.

EXAMPLE VIII

| Ingredients | Wt. % |
|---|---|
| $C_{14-15}$ alkyl polyethoxylate (2.25) sulfonic acid | 21.00 |
| $C_{12-14}$ fatty acid N-methyl glucamide[1] | 7.00 |
| Sodium tartrate mono- and di-succinate (80:20 mix) | 4.00 |
| Citric acid | 3.80 |
| $C_{12-14}$ fatty acid | 3.00 |
| Tetraethylene pentaamine ethoxylate (15-18) | 1.50 |
| Ethoxylated copolymer of polyethylene-polypropylene terephthalate polysulfonic acid | 0.20 |
| Protease B (34 g/l)[2] | 0.68 |
| Lipase (100 KLU/g)[3] | 0.47 |
| Cellulase (5000 cevu/g)[4] | 0.14 |
| Brightener 36[5] | 0.15 |
| Ethanol | 5.20 |
| Monoethanolamine | 2.00 |
| Sodium formate | 0.32 |
| 1,2 propane diol | 8.00 |
| Sodium hydroxide | 3.10 |
| Silicone suds suppressor | 0.0375 |
| Boric acid | 2.00 |
| Water/misc. | Balance to 100 |

[1]Prepared as disclosed above.
[2]Protease B is a modified bacterial serine protease described in European Patent Application Serial No. 87 303761 filed April 28, 1987, particularly pages 17, 24 and 98.
[3]Lipase used herein is the lipase obtained by cloning the gene from *Humicola lanuginosa* and expressing the gene in *Aspergillus oryzae*, as described in European Patent Application 0 258 068, commercially available under the trade name LIPOLASE (ex Novo Nordisk A/S, Copenhagen Denmark).
[4]Cellulase used herein is sold under the trademark CAREZYME (Novo Nordisk, A/S, Copenhagen Denmark).
[5]Brightener 36 is commercially available as TINOPAL TAS 36.

EXAMPLE IX

A liquid laundry detergent composition suitable for use at the relatively high concentrations common to front-loading automatic washing machines, especially in Europe, and over a wide range of temperatures is as follows.

| Ingredient | Wt. % |
|---|---|
| Coconutalkyl ($C_{12}$) N-methyl glucamide | 14 |
| $C_{14-15}$EO(2.25) sulfate, Na salt | 10.0 |
| $C_{14-15}$EO(7) | 4.0 |
| $C_{12-14}$ alkenylsuccinic anhydride[1] | 4.0 |
| $C_{12-14}$ fatty acid* | 3.0 |
| Citric acid (anhydrous) | 4.6 |
| Protease (enzyme)[2] | 0.37 |
| Termamyl (enzyme)[3] | 0.12 |
| Lipolase (enzyme)[4] | 0.36 |
| Carezyme (enzyme)[5] | 0.12 |
| Dequest 2060S[6] | 1.0 |
| NaOH (pH to 7.6) | 5.5 |
| 1,2 propanediol | 4.7 |
| Ethanol | 4.0 |
| Sodium metaborate | 4.0 |
| $CaCl_2$ | 0.014 |
| Ethoxylated tetraethylene pentamine[7] | 0.4 |
| Brightener[8] | 0.13 |
| Silane[9] | 0.04 |
| Soil release polymer[10] | 0.2 |
| Silicone (suds control)[11] | 0.4 |
| Silicone dispersant[12] | 0.2 |

-continued

| Ingredient | Wt. % |
|---|---|
| Water and minors | Balance |

[1]As SYNPRAX 3 from ICI or DTSA from Monsanto.
[2]As Protease B as described in EPO 0342177 November 15, 1989, percentage at 40 g/l.
[3]Amylase, from NOVO; percentage at 300 KNU/g
[4]Lipase, from NOVO; percentage at 100 KLU/g
[5]Cellulase from NOVO; percentage at 5000 CEVU/l.
[6]Available from Monsanto.
[7]From BASF as LUTENSOL P6105.
[8]BLANKOPHOR CPG766, Bayer.
[9]Silane corrosion inhibitor, available as A1130 from Union Carbide or DYNASYLAN TRIAMINO from Hüls.
[10]Polyester, per U.S. Pat. 4,711,730.
[11]Silicone suds control agent available as Q2-3302 from Dow Corning.
[12]Dispersant for silicone suds control agent available as DC-3225C from Dow Corning.
*Preferred fatty acid is topped palm kernel, comprising 12% oleic and 2% each of stearic and linoleic.

EXAMPLE X

In any of the foregoing examples, the fatty acid glucamide surfactant can be replaced by an equivalent amount of the maltamide surfactant, or mixtures of glucamide/maltamide surfactants derived from plant sugar sources. In the compositions the use of ethanolamides appears to help cold temperature stability of the finished formulations. Moreover, the use of sulfobetaine (aka "sultaine") surfactants provides superior sudsing.

In the event that especially high sudsing compositions are desired (e.g., dishwashing), it is preferred that less than about 5%, more preferably less than about 2%, most preferably substantially no $C_{14}$ or higher fatty acids be present, since these can suppress sudsing. Accordingly, the formulator of high sudsing compositions will desirably avoid the introduction of suds-suppressing amounts of such fatty acids into high sudsing compositions with the polyhydroxy fatty acid amides, and/or avoid the formation of $C_{14}$ and higher fatty acids on storage of the finished compositions. One simple means is to use $C_{12}$ ester reactants to prepare the polyhydroxy fatty acid amides herein. Fortunately, the use of amine oxide or sulfobetaine surfactants can overcome some of the negative sudsing effects caused by the fatty acids. Conversely, if low sudsing is desired, AE or DC-544 (Dow Corning) are additional examples of useful suds-suppressing agents herein.

It will be appreciated by those skilled in the chemical arts that the preparation of the polyhydroxy fatty acid amides herein using the di- and higher saccharides such as maltose will result in the formation of polyhydroxy fatty acid amides wherein linear substituent Z is "capped" by a polyhydroxy ring structure. Such materials are fully contemplated for use herein and do not depart from the spirit and scope of the invention as disclosed and claimed.

What is claimed is:

1. In a process for preparing a clear, isotropic highly-built liquid detergent composition comprising one or more conventional anionic, nonionic or cationic detersive surfactants, optional detersive adjuncts, and optical brighteners, the improvement which comprises adding said optical brighteners to said liquid detergent composition in the form of a premix comprising:

(a) from about 1% to about 20% by weight of one or more optical brighteners;

(b) from about 10% to about 60% by weight of one or more polyhydroxy fatty acid amides of the general formula

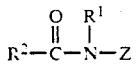

where $R^1$ is H, a $C_1$-$C_4$ hydrocarbyl, 2-hydroxy ethyl, 2-hydroxy propyl, or mixtures thereof, $R^2$ is a $C_5$-$C_{31}$ hydrocarbyl group, and Z is a polyhydroxyhydrocarbyl having a linear hydrocarbyl chain with at least 3 hydroxyl groups attached to the chain, or an alkoxylated derivative thereof; and (c) from about 20% to about 89% by weight of a liquid carrier which is a member selected from the group consisting of water and mixtures of water and a $C_1$-$C_4$ monohydric alcohol, whereby a liquid detergent composition comprising at least about 8% by weight of said detersive surfactant, from about 0.01% to about 2% by weight of said optical brightener, from about 0.5% to about 15% by weight of said polyhydroxy fatty acid amide, from about 10% to about 50% by weight of builder and from about 30% to about 77% by weight of liquid carrier is secured.

2. A process according to claim 1 wherein the polyhydroxy fatty acid $R^2$ is $C_{11}$-$C_{17}$ alkyl or alkenyl and Z is derived from glucose, maltose or mixtures thereof available from plant sources.

* * * * *

UNITED STATES PATENT AND TRADEMARK OFFICE

CERTIFICATE OF CORRECTION

PATENT NO. : 5,174,927

DATED : December 29, 1992

INVENTOR(S) : S. L. Honsa

It is certified that error appears in the above-identified patent and that said Letters Patent is hereby corrected as shown below:

Column 3, line 40, "C3" should be --$C_3$--.

Column 5, lines 29 and 30,
"DETAILED DESCRIPTION OF THE INVENTION DETERGENT COMPOSITIONS
should be
--DETAILED DESCRIPTION OF THE INVENTION
DETERGENT COMPOSITIONS--.

Column 7, line 13, "$C_{24}$alkylpolyglycoethersulfates" should be --$C_{24}$ alkylpolyglycoethersulfates--.

Column 15, line 65, "-$CH_2OH$, -$CH_2OH$," should be --$CH_2OH$,--.

Column 18, line 65, "$Na_{12}(AlO_2)_{12}(SiO_2)_{12}]xH_2O$" should be --$Na_{12}[(AlO_2)_{12}(SiO_2)_{12}]xH_2O$--.

Column 21, line 19, "homoand" should be --homo- and--.

Column 26, line 67, "$C_1$-$C_4$or" should be --$C_1$-$C_4$ or--.

Column 27, line 12, "$_4$alkylene" should be --$_4$ alkylene--.

Column 46, line 21, "All runs give" should start a new paragraph.

UNITED STATES PATENT AND TRADEMARK OFFICE

CERTIFICATE OF CORRECTION

PATENT NO. : 5,174,927
DATED : December 29, 1992
INVENTOR(S) : S. L. Honsa

It is certified that error appears in the above-indentified patent and that said Letters Patent is hereby corrected as shown below:

Column 47, line 46, "Step of" should be --Step 1 of--.

Signed and Sealed this
Fifth Day of April, 1994

Bruce Lehman

*Attest:*

BRUCE LEHMAN

*Attesting Officer*

*Commissioner of Patents and Trademarks*